US010906308B2

(12) United States Patent
Tanaka et al.

(10) Patent No.: US 10,906,308 B2
(45) Date of Patent: Feb. 2, 2021

(54) LIQUID JETTING APPARATUS AND METHOD OF PRODUCING LIQUID JETTING APPARATUS

(71) Applicant: BROTHER KOGYO KABUSHIKI KAISHA, Nagoya (JP)

(72) Inventors: Taiki Tanaka, Yokkaichi (JP); Keita Hirai, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/798,726

(22) Filed: Feb. 24, 2020

(65) Prior Publication Data

US 2020/0189278 A1 Jun. 18, 2020

Related U.S. Application Data

(60) Continuation of application No. 16/528,745, filed on Aug. 1, 2019, now Pat. No. 10,611,149, which is a (Continued)

(30) Foreign Application Priority Data

Jan. 29, 2016 (JP) ..... 2016-015191

(51) Int. Cl.
*B41J 2/14* (2006.01)
*B41J 2/16* (2006.01)

(52) U.S. Cl.
CPC ..... *B41J 2/14201* (2013.01); *B41J 2/14032* (2013.01); *B41J 2/14233* (2013.01);

(Continued)

(58) Field of Classification Search
CPC .. B41J 2/14201; B41J 2/14233; B41J 2/1628; B41J 2/1632; B41J 2/1629; B41J 2/161;

(Continued)

(56) References Cited

U.S. PATENT DOCUMENTS 10,155,380 B2 12/2018 Tanaka et al.
2008/0018716 A1* 1/2008 Noguchi ..... H01L 41/0973 347/71

(Continued)

FOREIGN PATENT DOCUMENTS

EP 0 963 846 A2 12/1999
JP 2003-159798 A 6/2003

(Continued)

OTHER PUBLICATIONS

Chinese Office Action dated Aug. 20, 2018 received in Chinese Patent Application No. 201710061581.3, together with an English language translation.

(Continued)

*Primary Examiner* — Yaovi M Ameh
(74) *Attorney, Agent, or Firm* — Scully, Scott, Murphy & Presser, P.C.

(57) ABSTRACT

There is provided a liquid jetting apparatus, including: a first pressure chamber and a second pressure chamber arranged in a first direction; a first insulating film covering the first and second pressure chambers; a first piezoelectric element arranged to face the first pressure chamber with the first insulating film being intervened therebetween; a second piezoelectric element arranged to face the second pressure chamber with the first insulating film being intervened therebetween; a trace arranged between the first and the second piezoelectric elements adjacent to each other in the first direction; and a second insulating film covering the trace. An end, in the first direction, of a part of the second insulating film covering the trace between the first piezoelectric element and the second piezoelectric element is positioned inside an end of a partition wall partitioning the first pressure chamber and the second pressure chamber.

12 Claims, 17 Drawing Sheets

Related U.S. Application Data continuation of application No. 16/180,551, filed on Nov. 5, 2018, now Pat. No. 10,406,810, which is a division of application No. 15/416,668, filed on Jan. 26, 2017, now Pat. No. 10,155,380.

(52) U.S. Cl.
CPC ..... *B41J 2/161* (2013.01); *B41J 2/164* (2013.01); *B41J 2/1607* (2013.01); *B41J 2/1623* (2013.01); *B41J 2/1628* (2013.01); *B41J 2/1629* (2013.01); *B41J 2/1631* (2013.01); *B41J 2/1632* (2013.01); *B41J 2/1642* (2013.01); *B41J 2/1646* (2013.01); *B41J 2002/14241* (2013.01); *B41J 2002/14491* (2013.01)

(58) Field of Classification Search
CPC ..... B41J 2/1642; B41J 2/1623; B41J 2/1646; B41J 2/1607; B41J 2/164; B41J 2/1631; B41J 2002/14241; B41J 2002/14491; B41J 2/14032
See application file for complete search history.

(56) References Cited

U.S. PATENT DOCUMENTS

| | | | | |
|---|---|---|---|---|
| 2009/0244212 | A1* | 10/2009 | Shimada | B41J 2/055 347/71 |
| 2012/0056940 | A1* | 3/2012 | Sakurai | B41J 2/04501 347/54 |
| 2012/0069101 | A1 | 3/2012 | Kato et al. | |
| 2012/0120159 | A1 | 5/2012 | Nakao | |
| 2012/0212545 | A1 | 8/2012 | Mizukami et al. | |
| 2013/0050354 | A1* | 2/2013 | Kato | B41J 2/14233 347/71 |
| 2014/0132677 | A1 | 5/2014 | Kondo | |
| 2015/0273832 | A1 | 10/2015 | Hirai et al. | |
| 2015/0321477 | A1 | 11/2015 | Gao et al. | |

FOREIGN PATENT DOCUMENTS

| | | |
|---|---|---|
| JP | 2013-49191 A | 3/2013 |
| JP | 2015-182440 A | 10/2015 |

OTHER PUBLICATIONS

Extended European Search Report dated Jul. 4, 2019 received in European Application No. 19 16 3498.9.
European Office Action dated Apr. 9, 2018 received in European Application No. 17 15 3590.9.
Extended European Search Report dated Jul. 14, 2017 received in European Application No. 17 15 3590.9.
Japanese Notice of Reasons for Refusal dated Dec. 24, 2019 received in Japanese Patent Application No. 2016-015191, together with an English-language translation.
United States Notice of Allowance dated Nov. 27, 2019 received in related U.S. Appl. No. 16/528,745.
United States Notice of Allowance dated Apr. 23, 2019 received in related U.S. Appl. No. 16/180,551.
United States non-Final Office Action dated Dec. 14, 2018 received in related U.S. Appl. No. 16/180,551.
United States Notice of Allowance dated Aug. 9, 2018 received in related U.S. Appl. No. 15/416,668.
United States non-Final Office Action dated Mar. 1, 2018 received in related U.S. Appl. No. 15/416,668.

* cited by examiner

LIQUID JETTING APPARATUS AND METHOD OF PRODUCING LIQUID JETTING APPARATUS

CROSS REFERENCE TO RELATED APPLICATIONS

This application is a continuation of U.S. patent application Ser. No. 16/528,745 filed on Aug. 1, 2019, which is a continuation of U.S. patent application Ser. No. 16/180,551 filed on Nov. 5, 2018, now U.S. Pat. No. 10,406,810, which is a divisional application of U.S. patent application Ser. No. 15/416,668 filed on Jan. 26, 2017, now U.S. Pat. No. 10,155,380, and claims priority from Japanese Patent Application No. 2016-015191 filed on Jan. 29, 2016, the disclosures of each of which are incorporated herein by reference in their entirety.

BACKGROUND

Field of the Invention

The present invention relates to a liquid jetting apparatus and a met of producing the liquid jetting apparatus.

Description of the Related Art

As a liquid jetting apparatus jetting liquid, an ink-jet head jetting ink from nozzles is known. This ink-jet head includes a head main body formed with pressure chambers and nozzles and a piezoelectric actuator applying pressure to the ink in each pressure chamber.

The pressure chambers of the head main body form four pressure chamber arrays arranged in a main scanning direction of the ink-jet head. The piezoelectric actuator includes a vibration plate covering the pressure chambers, a common electrode formed on the vibration plate, a piezoelectric body disposed on the common electrode, and individual electrodes disposed on the upper surface of the piezoelectric body while corresponding to the pressure chambers. It can be said that, each individual electrode, the common electrode, and a part of the piezoelectric body sandwiched between the two kinds of electrodes are disposed to face one pressure chamber, thus forming one piezoelectric element. Namely, the piezoelectric actuator includes the piezoelectric elements that are arranged in four arrays while corresponding to the pressure chambers.

The individual electrodes of the piezoelectric elements are connected to traces. Each of the traces is led from the corresponding one of the individual electrodes to the outside in the main scanning direction. In two piezoelectric element arrays at one side, traces connected to the individual electrodes of a piezoelectric element array disposed at the inside in the main scanning direction extend to the outside while running between two piezoelectric elements of a piezoelectric element array disposed at the outside in the main scanning direction. An end of each trace is provided with a pressure input terminal.

SUMMARY

Meanwhile, in order to prevent trace corrosion, etc., an insulating film may be provided in an area formed with the trace above a partition wall partitioning two pressure chambers. In that case, if the insulating film is disposed to partially cover, from above, the pressure chambers disposed at both sides of the trace, ends of the insulating film are positioned on the vibration plate covering the pressure chambers.

Inventors of the present application made an experimental actuator having a configuration in which the insulating film partially covers the pressure chambers from above, and then conducted a drive test. As a result, it has been revealed that the vibration plate has cracks starting at end positions of the insulating film.

An object of the present teaching is to prevent a film covering pressure chambers from having a crack which would be otherwise caused by a configuration in which an insulating film formed above a partition wall partially covers the pressure chambers from above.

According to an aspect of the present teaching, there is provided a liquid jetting apparatus including:

a first pressure chamber;

a second pressure chamber located next to the first pressure chamber in a first direction;

a first insulating film covering the first pressure chamber and the second pressure chamber;

a first piezoelectric element arranged above the first pressure chamber, the first insulating film being intervened between the first pressure chamber and the first piezoelectric element;

a second piezoelectric element arranged above the second pressure chamber, the first insulating film being intervened between the second pressure chamber and the second piezoelectric element;

a trace arranged between the first piezoelectric element and the second piezoelectric element in the first direction; and a second insulating film covering the trace, wherein the first pressure chamber includes a first end and a second end in the first direction, the second pressure chamber includes a third end and a fourth end in the first direction, and the second end of the first pressure chamber is located next to the third end of the second pressure chamber in the first direction, wherein the second insulating film includes two ends between the second end of the first pressure chamber and the third end of the second pressure chamber in the first direction.

In the present teaching, the end of the part of the second insulating film covering the at least one trace between the first piezoelectric element and the second piezoelectric element is positioned inside the end of the partition wall partitioning the first pressure chamber and the second pressure chamber. Thus, between the first piezoelectric element and the second piezoelectric element, the second insulating film does not overlap with the first pressure chamber and the second pressure chamber. In such a configuration, the end of the second insulating film is not positioned on each pressure chamber, and thus stress is less likely to concentrate on the first insulating film covering each pressure chamber. This prevents the first insulating film from having a crack.

DESCRIPTION OF THE EMBODIMENTS

Figure 1:
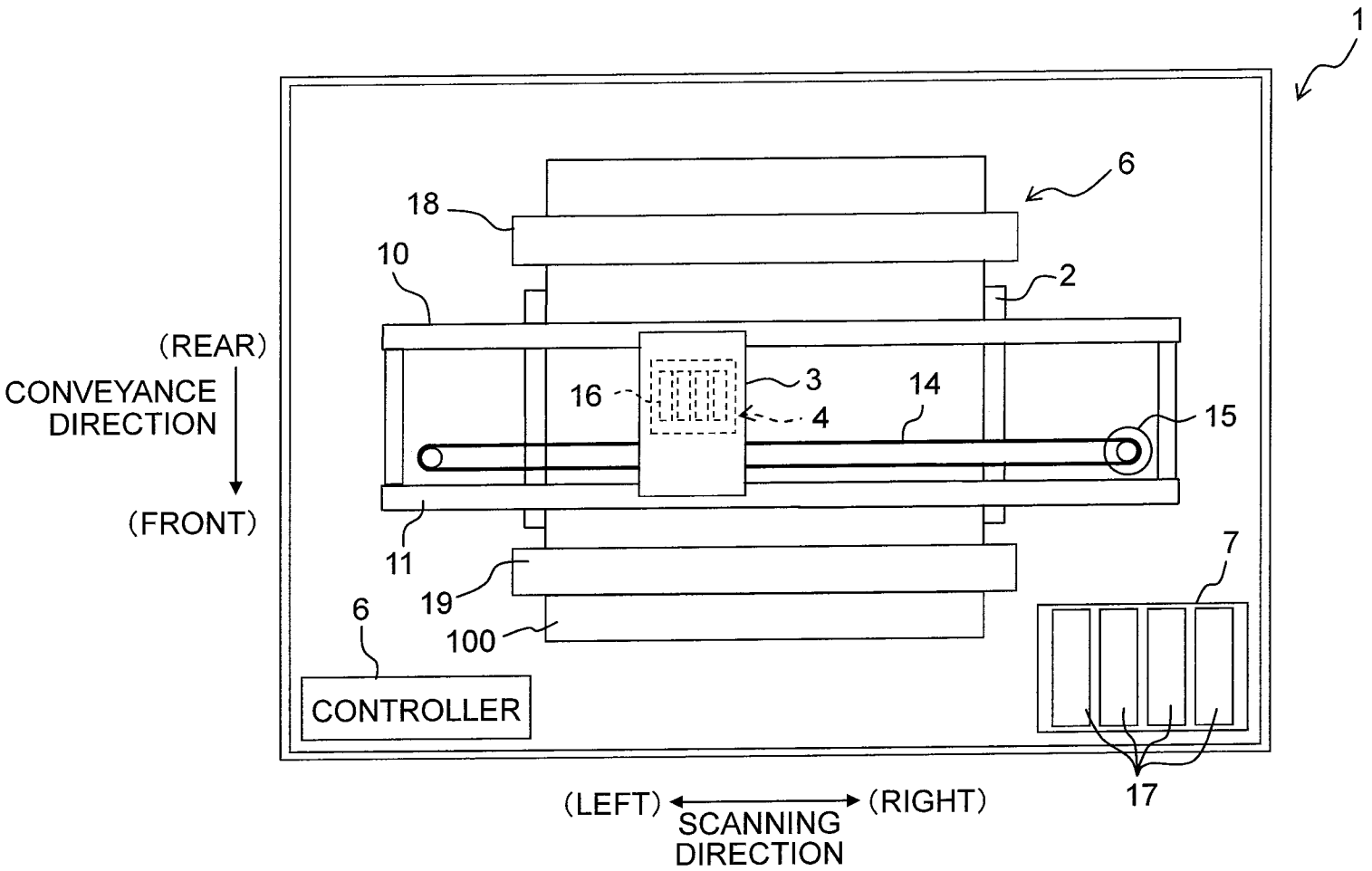
FIG. 1 is a schematic plan view of a printer according to an embodiment of the present teaching.

Subsequently, an embodiment of the present teaching will be described. FIG. 1 is a schematic plan view of a printer according to the present embodiment. At first, a schematic configuration of an ink-jet printer 1 will be explained with reference to FIG. 1. The respective front, rear, left, and right directions depicted in FIG. 1 are defined as "front", "rear", "left", and "right" of the printer. Further, a front side of each paper surface is defined as "up" or pward", and a rear side of each paper surface is defined as "down" or "downward". In the following, the explanation will be made by appropriately using the front (side), the rear (side), the left (side), the right (side), the up (upper side), and the down (lower side) defined as described above.

<Schematic Configuration of Printer>

As depicted in FIG. 1, the ink-jet printer 1 includes a platen 2, a carriage 3, an ink-jet head 4, a conveyance mechanism 5, a controller 6, and the like.

A recording sheet 100 as a recording medium is placed on an upper surface of the platen 2. The carriage 3 is configured to reciprocate in a left-right direction (hereinafter referred to as a scanning direction) in an area facing the platen 2 along two guide rails 10 and 11. An endless belt 14 is connected to the carriage 3, and a carriage drive motor 15 drives the endless belt 14 to move the carriage 3 in the scanning direction.

The ink-jet head 4, which is installed to the carriage 3, moves in the scanning direction together with the carriage 3. The ink-jet head 4 includes four head units 16 arranged in the scanning direction. The four head units 16 are connected, via unillustrated tubes, to a cartridge holder 7 to which ink cartridges 17 of four colors (black, yellow, cyan, and magenta) are installed. Each of the head units 16 includes nozzles 24 (see FIGS. 2 to 5) formed on a lower surface thereof (the rear side of the paper surface of FIG. 1). Each of the inks supplied from the corresponding one of ink cartridges 17 is jetted from nozzles 24 of each of the head units 16 to the recording sheet 100 placed on the platen 2.

The conveyance mechanism 5 includes two conveyance rollers 18 and 19 disposed to sandwich the platen 2 in a front-rear direction. The conveyance mechanism 5 conveys the recording sheet 100 placed on the platen 2 frontward (hereinafter also referred to as a conveyance direction) by use of the two conveyance rollers 18 and 19.

The controller 6 includes a Read Only Memory (ROM), a Random Access Memory (RAM), an Application Specific Integrated Circuit (ASIC) including various control circuits, and the like. The controller 6 controls the ASIC to execute a variety of processing, such as printing for the recording sheet 100, in accordance with programs stored in the RUM. For example, in the print processing, the controller 6 controls the ink-jet head 4, the carriage drive motor 15, and the like to perform printing of an image or the like on the recording sheet 100 based on a printing command input from an external apparatus, such as a PC. In particular, the controller 6 alternately performs an ink jetting operation in which the ink-jet head 4 jets ink while moving in the scanning direction together with the carriage 3 and a conveyance operation in which conveyance rollers 18 and 19 convey the recording sheet 100 in the conveyance direction by a predefined amount.

<Details of Ink-Jet Head>

Subsequently, a configuration of the ink-jet head 4 will be explained in detail. Since the four head units 16 of the ink-jet head 4 have the same configuration, one of the head units 16 will be explained and the remaining head units 16 are omitted from the explanation.

Figure 2:
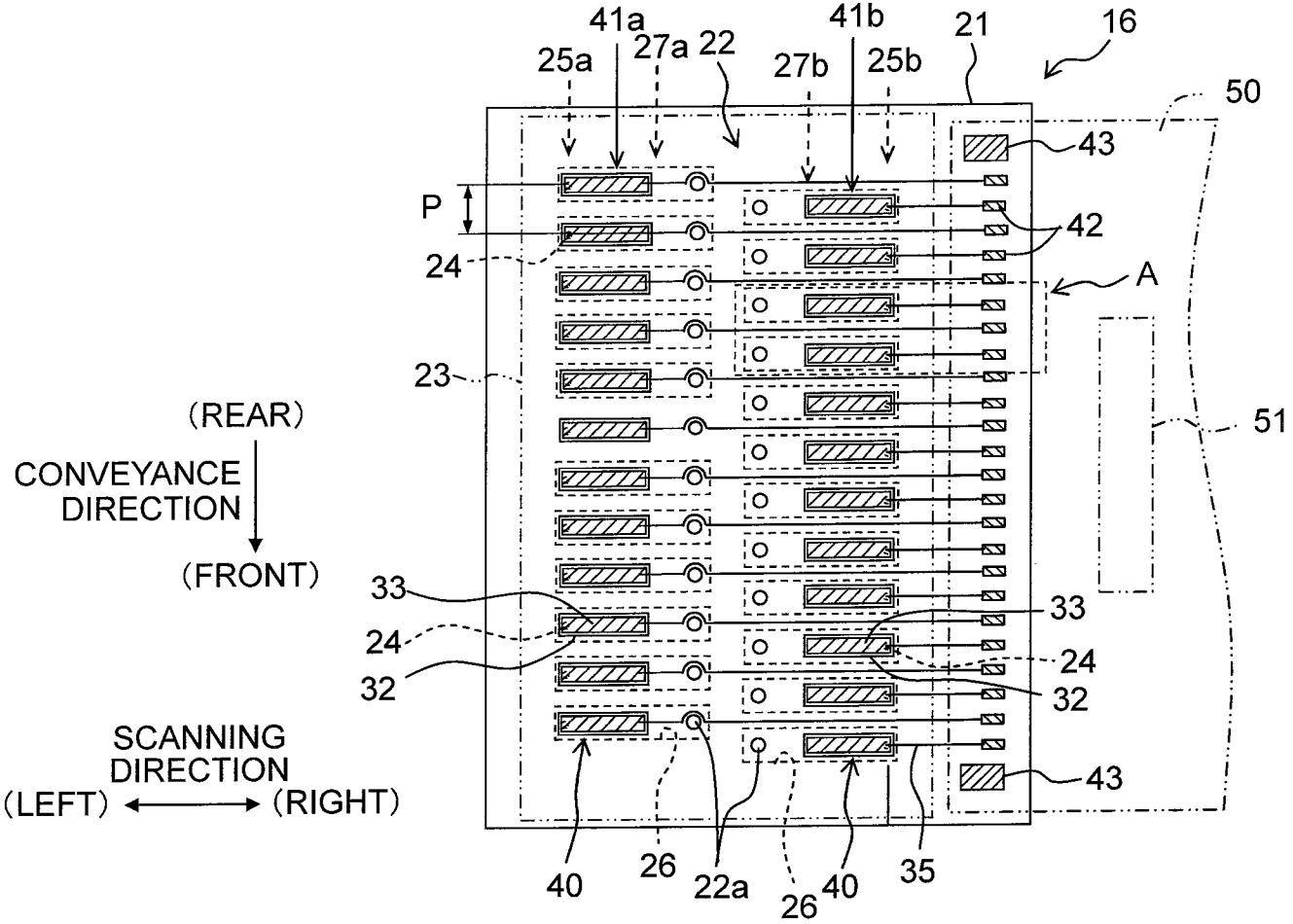
FIG. 2 is a top view of a head unit of an ink-jet head.

As depicted in FIGS. 2 to 5, the head unit 16 includes a nozzle plate 20, a channel substrate 21, a piezoelectric actuator 22, and a reservoir formation member 23. In FIG. 2, for the purpose of a simple illustration, the reservoir formation member 23 disposed above the channel substrate 21 and the piezoelectric actuator 22 is depicted by two-dot chain lines to show its external form only.

<Nozzle Plate>

The nozzle plate 20 is made from a metal material, such as stainless steel, or a synthetic resin material, such as silicon or polyimide. The nozzle plate 20 includes nozzles 24. As depicted in FIG. 2, the nozzles 24, from which an ink having any color of the four colors is jetted, are arrayed in the conveyance direction to form two nozzle arrays 25*a*, 25*b* arranged in the left-right direction. The nozzles 24 of the nozzle array 25*a* are arranged to deviate from the nozzles 24 of the nozzle array 25*b* in the conveyance direction by a half (P/2) of an arrangement pitch P of each nozzle array 25.

<Channel Substrate>

The channel substrate 21 is made from silicon. The nozzle plate 20 is joined to a lower surface of the channel substrate 21. The channel substrate 21 includes pressure chambers 26 communicating with the nozzles 24, respectively. Each of the pressure chambers 26 has a rectangular planar shape elongated in the scanning direction. The pressure chambers 26 are arrayed in the conveyance direction while corresponding to the array of the nozzles 24 described above, thus forming two pressure chamber arrays 27 (27*a* and 27*b*) arranged in the left-right direction.

<Piezoelectric Actuator>

The piezoelectric actuator 22 applies, to the ink in each pressure chamber 26, jetting energy for jetting the ink from each nozzle 24. The piezoelectric actuator 22 is disposed on an upper surface of the channel substrate 21.

As depicted in FIGS. 2 to 5, the piezoelectric actuator 22 includes a vibration film 30, piezoelectric elements 40, a protective film 34, an insulating film between layers 36 (hereinafter simply referred to as an insulating film 36), traces 35, and a trace protective film 37. In FIG. 2, for the purpose of a simple illustration, illustration is omitted for the protective film 34 covering piezoelectric films 32 and the trace protective film 37 covering the traces 35 which are otherwise depicted in FIGS. 3 to 5.

Figure 3:
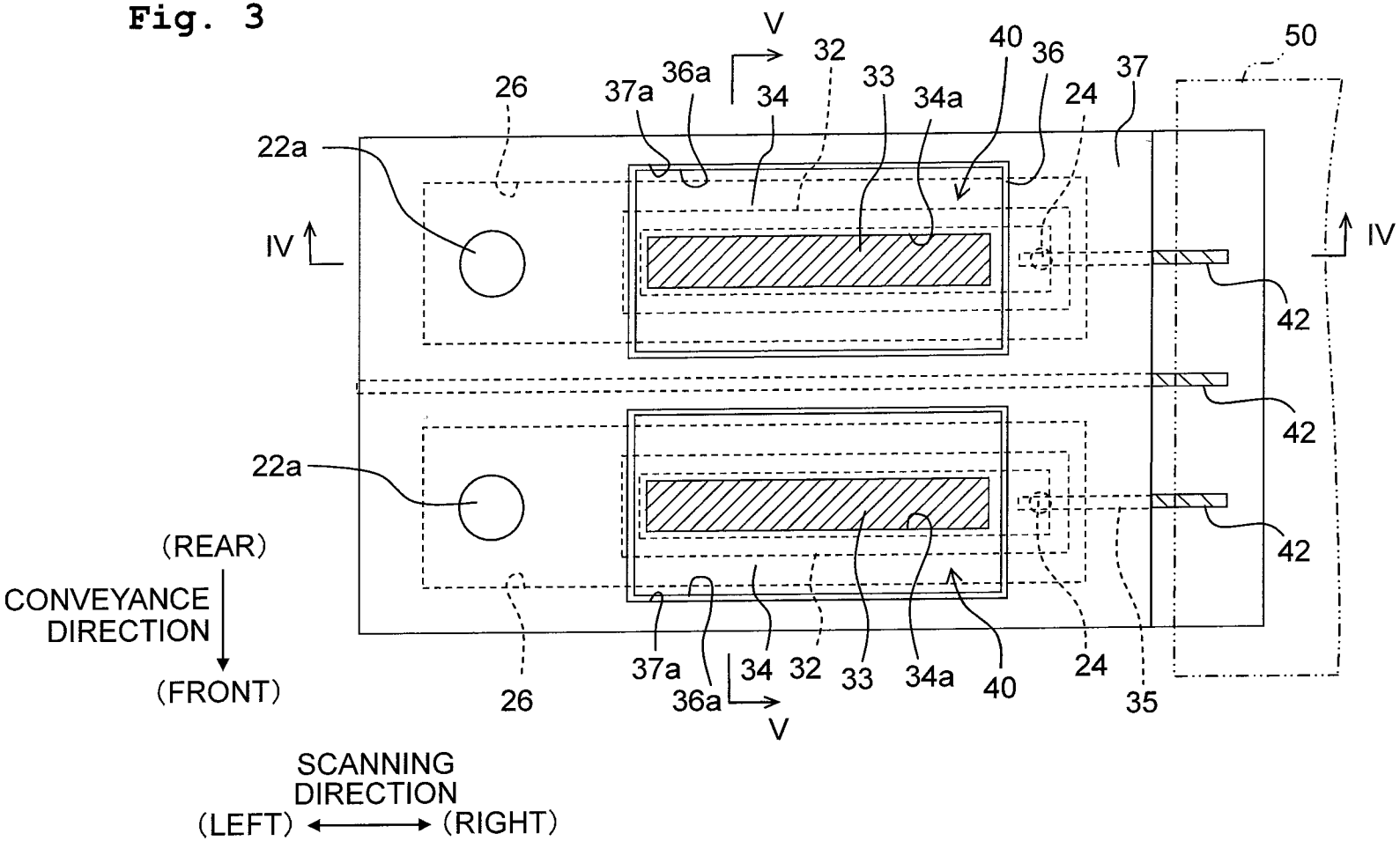
FIG. 3 is an enlarged view depicting a portion A of FIG. 2.

As depicted in FIGS. 2 and 3, communicating holes 22*a* are formed in the piezoelectric actuator 22 at positions overlapping respectively with ends of the pressure chambers 26. The communicating holes 22*a* allow channels in the after-mentioned reservoir formation member 23 to communicate with the pressure chambers 26, respectively.

The vibration film 30 is disposed on an entire area of the upper surface of the channel substrate 21 to cover the pressure chambers 26. The vibration film 30 is made from silicon dioxide ($SiO_2$), silicon nitride ($SiN_x$), or the like. The thickness of the vibration film 30 is, for example, approximately 1 μm.

The piezoelectric elements 40 are disposed to face the pressure chambers 26 with the vibration film 30 being intervened therebetween. Namely, the piezoelectric elements 40, which are arrayed in the conveyance direction while corresponding to the array of the pressure chambers 26, form two piezoelectric element arrays 41 arranged in the scanning direction. Each of the piezoelectric elements 40 includes a lower electrode 31, the piezoelectric film 32, and an upper electrode 33.

Figure 5:
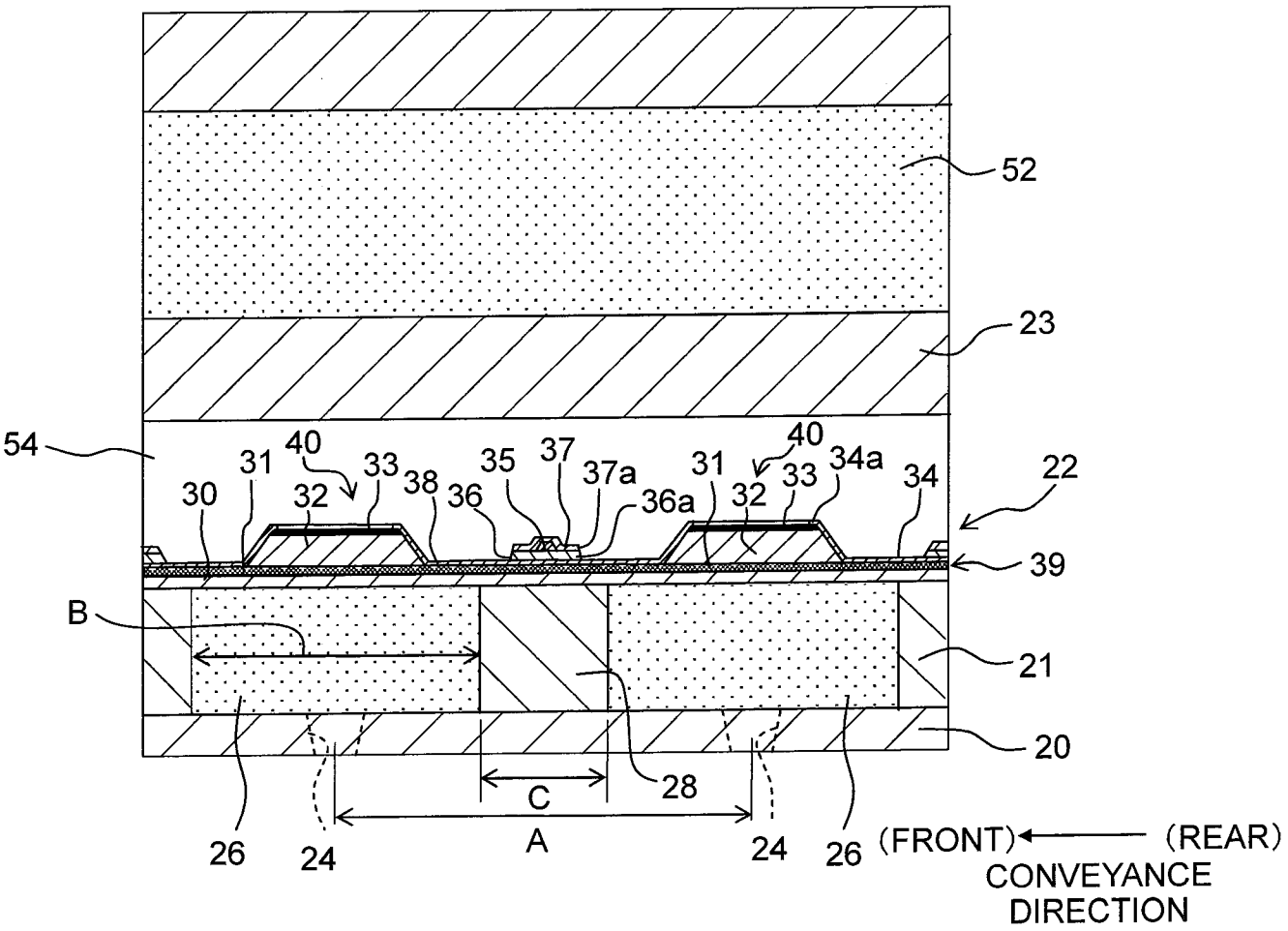
FIG. 5 is a cross-sectional view taken along a line V-V of FIG. 3.

The lower electrode 31 is formed on an upper surface of the vibration film 30 to face the pressure chamber 26. As depicted in FIG. 5, a conductive film 38 is formed in an area between pressure chambers 26 by using the material which is the same as that used for the lower electrode 31. The conductive film 38 enables electrical conduction between the lower electrodes 31 of the pressure elements 40. In other words, a single large common electrode 39, which is formed by the lower electrodes 31 and the conductive films 38 disposed therebetween, is disposed on almost the entire area of the upper surface of the vibration film 30. The material of the lower electrodes 31 is not particularly limited, and it is possible to adopt, for example, a material having a two-layer structure of platinum (P1) and titanium (Ti). In that case, a platinum layer may be approximately 200 nm and a titanium layer may be approximately 50 nm.

Each piezoelectric film 32 is formed on the upper surface of the vibration film 30 via the lower electrode 31 in an area facing the pressure chamber 26. As depicted in FIG. 3, the piezoelectric film 32 has such a planar shape as smaller than the pressure chamber 26 and elongated in the scanning direction. The piezoelectric film 32 is made from, for example, a piezoelectric material composed primarily of lead zirconate titanate (PZT) that is a mixed crystal of lead titanate and lead zirconate. The thickness of the piezoelectric film 32 is, for example, approximately 1 to 5 μm.

Each upper electrode 33 has a rectangular planar shape that is slightly smaller than the piezoelectric film 32. The upper electrode 33 is formed on a central portion of an upper surface of the piezoelectric film 32. The upper electrode 33 is made from, for example, iridium (Ir). The thickness of the upper electrode 33 is, for example, approximately 80 nm.

Figure 4:
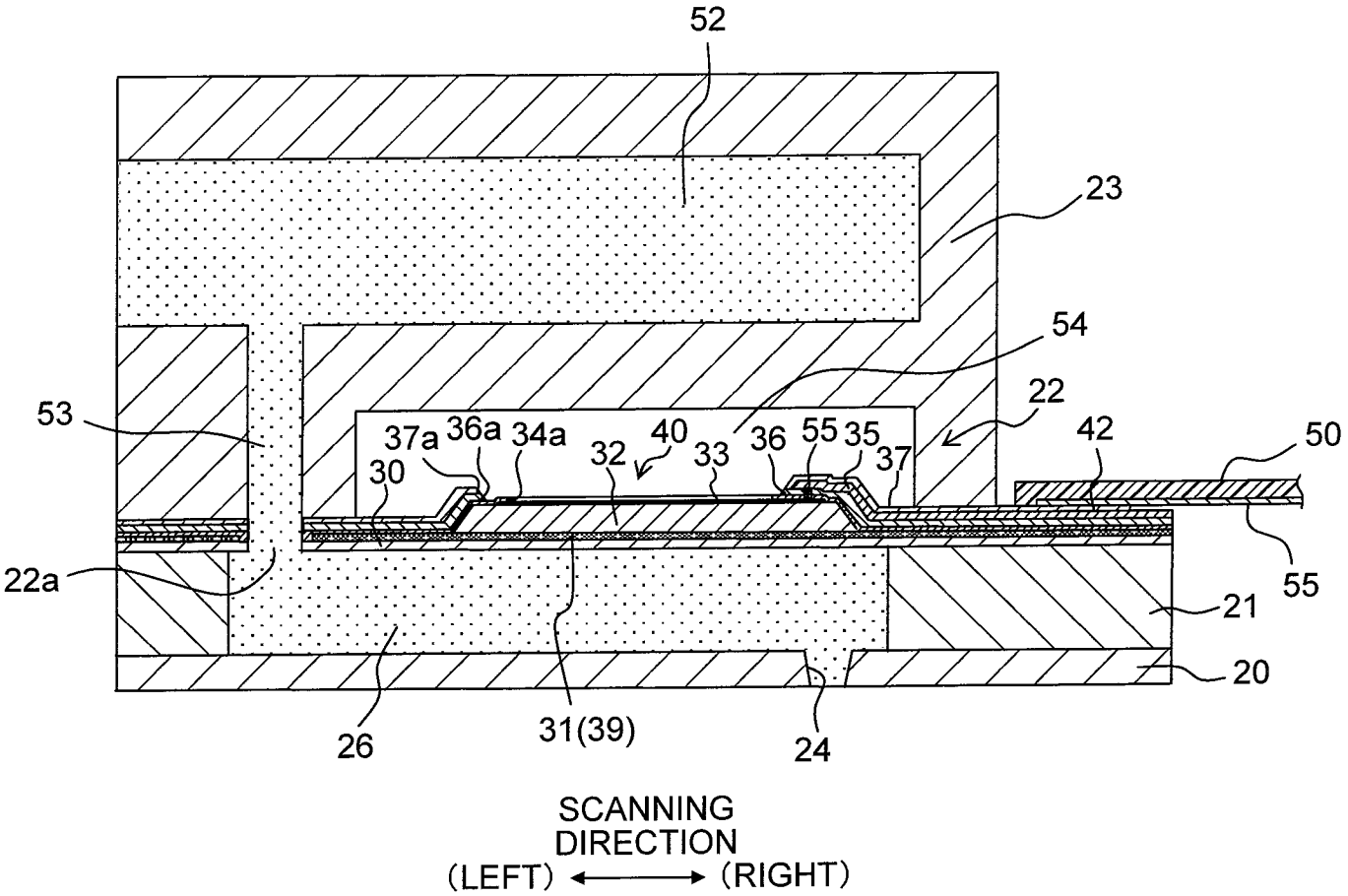
FIG. 4 is a cross-sectional view taken along a line IV-IV of FIG. 3.

As depicted in FIGS. 3 to 5, the protective film 34, which is arranged across the piezoelectric films 32 of the piezoelectric elements 40, extends over almost the entire area of the upper surface of the vibration film 30. The protective film 34 prevents moisture contained in the air from coming into the piezoelectric films 32. The protective film 34 is made from a waterproof material, such as alumina ($Al_2O_3$). The thickness of the protective film 34 is, for example, approximately 80 nm. If moisture in the air comes into the piezoelectric films 32, then deterioration will occur in the piezoelectric films 32. In the present embodiment, the protective film 34 covering the piezoelectric films 32 prevents moisture from coming into the piezoelectric films 32.

In order not to make the protective film 34 obstruct deformation of the piezoelectric films 32, the protective film 34 includes rectangular openings 34*a* at parts overlapping with the central portions of the upper surfaces of the piezoelectric films 32 as viewed in a thickness direction of the protective film 34. Thus, a large part of each upper electrode 33 is exposed from the protective film 34. In an inside area of each opening 34*a*, the piezoelectric film 32 is not covered with the protective film 34, but covered with the upper electrode 33. Thus, moisture is prevented from coming into each piezoelectric film 32 from the outside.

As depicted in FIGS. 3 to 5, the insulating film 36 is formed on the protective film 34. The insulating film 36 includes openings 36*a* each of which is slightly larger than the opening 34*a* of the protective film 34. Thus, the insulating film 36 is disposed to cover a partition wall 28 partitioning pressure chambers 26 and a large part of the piezoelectric element 40 is exposed from the insulating film 36. Details of a formation range of the insulating film 36 around the piezoelectric element 40 will be described together with a formation range of the trace protective film 37.

Each of the traces 35, which will be described next, is disposed on the insulating film 36. The insulating film 36 is provided primarily for improving the insulation quality between the conductive film 38 of the common electrode 39 and each trace 35. Without being limited to any particular material, the insulating film 36 is made from, for example, silicon dioxide ($SiO_2$). Further, from the point of view of securing the insulation quality between the common electrode 39 and each trace 35, the insulating film 36 preferably has a certain film thickness; such as from 300 to 500 nm.

Each of the traces, which is disposed on the insulating film 36, applies voltage to the corresponding one of the piezoelectric elements 40. The trace 35 is arranged with its one end hanging over an upper surface of a right end of the piezoelectric film 32 across the protective film 34 and insulating film 36. Further, a conducting portion 55 is provided at parts, of the protective film 34 and the insulating film 36, covering a right end of the upper electrode 33 to penetrate through those films. The conducting portion 55 enables electrical conduction between the trace 35 and the right end of the upper electrode 33. The traces 35 corresponding to the piezoelectric elements 40 extend rightward respectively from the corresponding upper electrodes 33. The traces 35 are made from, for example, aluminum (Al).

The traces 35, which are led from the left-side piezoelectric element array 41*a* of the two piezoelectric element arrays 41 arranged in the left-right direction, are disposed on the insulating film 36 to run between piezoelectric elements 40 forming the right-side piezoelectric element array 41*b*. Namely, the traces 35 connected to the left-side piezoelectric elements 40 extend rightward at a position above the partition wall 28 to run between two piezoelectric elements 40 forming the right-side piezoelectric element array. In order to prevent trace breaking and the like as much as possible, each of the traces 35 preferably has a certain thickness or more, such as approximately 1 μm.

The insulating film 36, which is disposed under each trace 35, extends up to a right end of the channel substrate 21. As depicted in FIG. 2, in the right end of the channel substrate 21, drive contact portions 42 are arrayed on the insulating film 36 in the conveyance direction. The traces 35, which are drawn out rightward respectively from the upper electrodes 33, are connected to the drive contact portions 42. Further, in the right end of the channel substrate 21, two ground contact portions 43 are arranged at the two opposite sides of the drive contact portions 42 in the conveyance direction. The ground contact portions 43 are connected to the common electrode 39 disposed on a lower side of the protective film 34 via conducting portions (not depicted) penetrating through the protective film 34 and the insulating film 36.

The trace protective film 37 is formed on the insulating film 36 to cover each trace 35. The trace protective film 37 is provided for main purposes of protecting the trace 35 and securing the insulation between the traces 35. The trace protective film 37 is made from, for example, silicon nitride (SiN). The thickness of the trace protective film 37 is, for example, from 100 nm to 1 μm.

As depicted in FIGS. 3 to 5, the trace protective film 37 is formed with openings 37*a* like the insulating film 36. The opening 37*a* of the trace protective film 37 has substantially the same size as that of the opening 36*a* of the insulating film 36. Thus, the trace protective film 37 is disposed above the partition wall 28 partitioning pressure chambers 26 to cover each trace 35, and large parts of the piezoelectric elements 40 disposed at both sides of the trace 35 are exposed from the trace protective film 37. The opening 37*a* of the wiring protective film 37 is slightly, larger than the opening 34*a* of the protective film 34.

As depicted in FIGS. 3 and 4, the trace protective film 37 extends to the right end of the channel substrate 21 to cover a range including connection portions between the traces 35 and the drive contact portions 42. Meanwhile, the drive contact portions 42 and the ground contact portions 43 are exposed from the trace protective film 37, and they are electrically connected to an after-mentioned COF 50 that is to be joined to an upper surface of the right end of the channel substrate 21.

An explanation will be made about a formation range of the insulating film 36 and the trace protective film 37 around each piezoelectric element 40 in detail.

Figure 6:
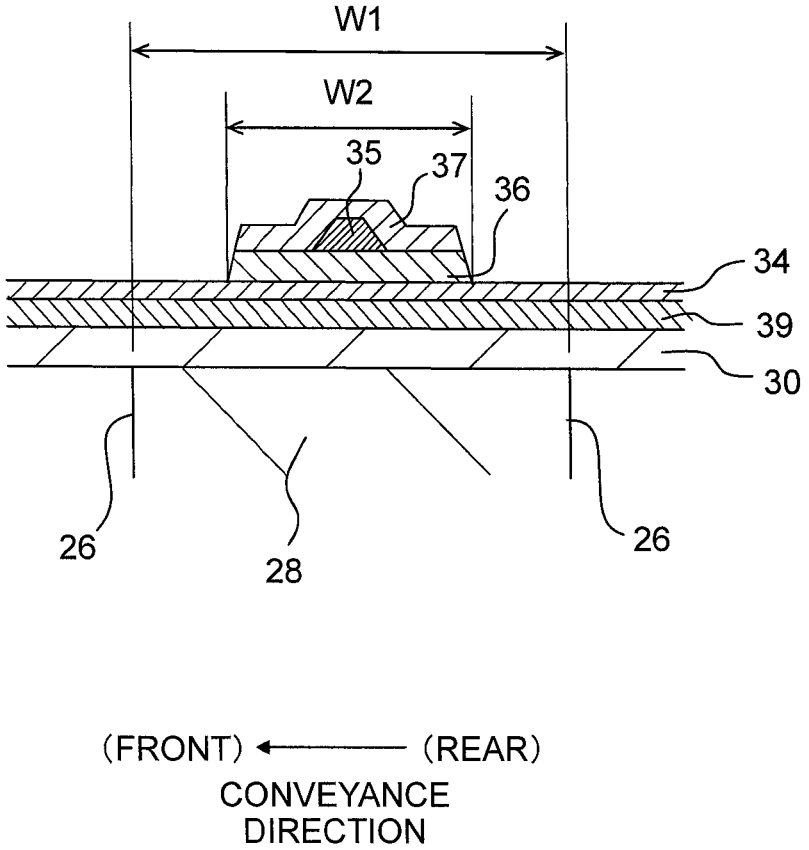
FIG. 6 is an enlarged view depicting surroundings of a partition wall of FIG. 5.

At first, a formation range of the films 36, 37 in the conveyance direction, i.e., a lateral direction of the pressure chamber 26 will be described. As depicted in FIGS. 3, 5, and 6, the insulating film 36 is disposed above the partition wall 28 between two piezoelectric elements 40 adjacent to each other in the conveyance direction. Further, the trace protective film 37 is disposed to cover each trace 35 disposed on the insulating film 36.

Between the two piezoelectric elements 40, both ends of the trace protective film 37 and the insulating film 36 in the conveyance direction are positioned inside ends of the partition wall 28. Namely, the trace protective film 37 and the insulating film 36 disposed above the partition wall 28 do not extend to areas facing the pressure chambers 26 partitioned by the partition wall 28. In that configuration, the ends of the insulating film 36 and the trace protective film 37 in the conveyance direction are not positioned above the pressure chambers 26. Thus, in a case of driving each piezoelectric element 40, the vibration film 30 covering each pressure chamber 26 is prevented from having cracks starting at the ends of the trace protective film 37 and the insulating film 36. As depicted in FIG. 6, a width W of the trace protective film 37 and the insulating film 37 is preferably shorter than a width W1 of the partition wall 28 by 3.8 μm or longer. The reason thereof will be described later.

Although the details will be described later, etching for the trace protective film 37 and etching for the insulating film 36 are performed through the same step. Thus, the positions of the openings 37*a* of the wiring protective film 37 are coincident with the positions of the openings 36*a* of the insulating film 36. This allows the ends of the trace protective film 37 and the ends of the insulting film 36 to be positioned at the same positions above the partition wall 28 in the conveyance direction. Actually, although end positions of the trace protective film 37 slightly, deviate from those of the insulating film 36 depending on taper shapes of film ends that are formed at the time of etching, the above-described configuration in which the ends of the trace protective film 37 and the ends of the insulting film 36 are positioned at the same positions includes a case in which such a slight deviation is present.

Subsequently, a formation range of the films 36, 37 in the scanning direction, i.e., a longitudinal direction of the pressure chamber 26 will be described with reference to FIG. 4. When the piezoelectric element 40 is deformed, stress is more likely to concentrate on positions of the vibration film 30 overlapping with ends of the piezoelectric film 32 in the longitudinal direction. In order to reduce the stress concentration, the insulating film 36 and the trace protective film 37 are formed to the above positions. Namely, as depicted in FIGS. 3 and 4, the insulating film 36 and the trace protective film 37 are disposed to overlap with both ends of the pressure chamber 26 in the longitudinal direction. This configuration allows the ends of the piezoelectric film 32 to be covered with the insulating film 36 and the trace protective film 37, thus increasing rigidity at those positions. Further, this configuration makes bending in the vicinities of ends of the pressure chamber 26 in the longitudinal direction gentle, thus preventing a crack in the vibration film 30.

When the trace protective film 37 and the insulating film 36 partially overlap with each pressure chamber 26 in the longitudinal direction and they do not extend over or cover each piezoelectric film 32, the vibration film 30 is more likely to have cracks starting at the ends of the films 36 and 37, like the case in which the films 36 and 37 extend beyond each pressure chamber 26 in the lateral direction of the pressure chamber 26. In the present teaching, the ends of the trace protective film 37 and the insulating film 36 extend over or cover the upper surface of each piezoelectric film 32, thus preventing cracks starting at the ends of the films 36, 37.

When the insulating film 36 and the trace protective film 37 partially overlap with each pressure chamber 26 and each piezoelectric film 32, the vibration film 30 may be prevented from being displaced in a case of driving the piezoelectric element 40. This problem, however, is more likely to be caused in film parts in the lateral direction of the pressure chamber 26 that has great influence on the displacement, and the problem is less likely to be caused in the film ends in the longitudinal direction that has small influence on the displacement. Thus, although the degree of displacement is slightly reduced, the present embodiment adopts a configuration in which the trace protective film 37 and the insulating film 36 partially overlap with each piezoelectric chamber 26 and each piezoelectric film 32 in the longitudinal direction of the pressure chamber 26 to reliably prevent the vibration film 30 from having a crack.

As depicted in FIGS. 2 to 4, the Chip On Film (COF) 50, which is a wiring member, is joined to an upper surface of a right end of the piezoelectric actuator 22. Traces 55*a* formed in the COF 50 are electrically connected to the drive contact portions 42, respectively. The controller 6 (see FIG. 1) of the printer 1 is connected to the other end of the COF 50 than the end connected to the drive contact portions 42. Further, a driver IC 51 is mounted on the COF 50.

Based on a control signal sent in from the controller 6, the driver IC 51 generates and outputs a drive signal for driving the piezoelectric actuator 22. The drive signal output from the driver IC 51 is input to the drive contact portions 42 via the traces 55*a* of the COF 50 and supplied to the respective upper electrodes 33 via the traces 35 of the piezoelectric actuator 22. The upper electrodes 33 supplied with the drive signal change in potential between a predefined drive potential and a ground potential. Further, the COF 50 is formed with a ground trace (not depicted), and the ground trace is electrically connected to the ground contact portions 43 of the piezoelectric actuator 22. This allows the common electrode 31 connected to the ground contact portions 43 to be constantly kept at the ground potential.

The following explanation will be made on an operation of the piezoelectric actuator 22 when supplied with the drive signal from the driver IC 51. Without being supplied with the drive signal, the upper electrodes 33 stay at the ground potential and thus have the same potential as the common electrode 39. From this state, if the drive signal is supplied to any of the upper electrodes 33 to apply the drive potential to that upper electrode 33, then due to the potential difference between that upper electrode 33 and the common electrode 39, the piezoelectric film 32 is acted on by an electric field parallel to its thickness direction. On that occasion, piezoelectric reverse effect makes the piezoelectric film 32 to extend in its thickness direction and to contract in its planar direction. Further, along with the contraction deformation of the piezoelectric film 32, the vibration film 30 bows to project toward the pressure chamber 26. By virtue of this, the pressure chamber 26 decreases in volume to produce a pressure wave inside the pressure chamber 26, thereby jetting liquid drops of the ink from the nozzle 24 in communication with the pressure chamber 26.

<Reservoir Formation Member>

As depicted in FIGS. 4 and 5, the reservoir formation member 23 is disposed on the far side (the upper side) of the piezoelectric actuator 22 from the channel substrate 21 across the piezoelectric actuator 22, and joined to the upper surface of the piezoelectric actuator 22 by way of adhesive. While the reservoir formation member 23 may be made from silicon, for example, as with the channel substrate 21, it may also be made from other materials than silicon, such as a metallic material or a synthetic resin material.

The reservoir formation member 23 has an upper half portion formed with a reservoir 52 extending in the conveyance direction. Through non-depicted tubes, the reservoir 52 is connected to the cartridge holder 7 (see FIG. 1) in which the ink cartridges 17 are installed.

As depicted in FIG. 4, the reservoir formation member 23 has a lower half portion formed with ink supply channels 53 extending downward from the reservoir 52. The ink supply channels 3 are in respective communication with the communicating holes 22*a* of the piezoelectric actuator 22. By virtue of this, inks are supplied from the reservoir 52 to the pressure chambers 26 of the channel substrate 21 via the ink supply channels 53 and the communicating holes 22*a*. Further, a concave protective cover 54 is also formed in the lower half portion of the reservoir formation member 23 to cover the piezoelectric elements 40 of the piezoelectric actuator 22.

Next, referring to FIGS. 7A to 7E through FIGS. 12A to 12D, an explanation will be made on steps of manufacturing the four head units 16 of the ink-jet head 4 and, in particular, focused on the step of manufacturing the piezoelectric actuator 22.

Figure 7A:
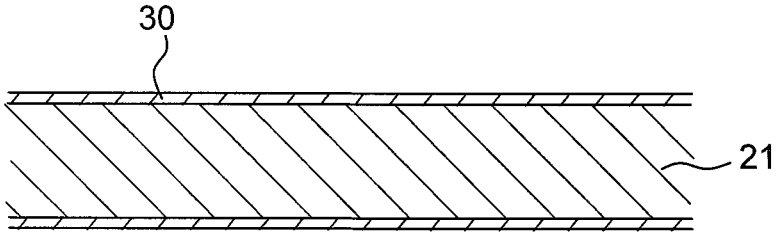
FIG. 7A depicts a step of forming a vibration film.
Figure 7B:
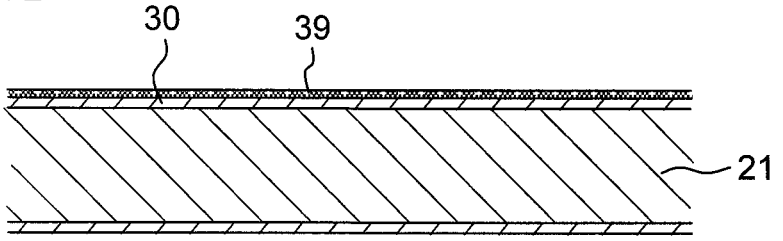
FIG. 7B depicts a step of forming a common electrode as a film.
Figure 7C:
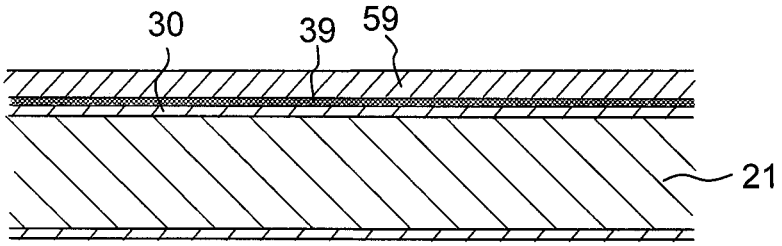
FIG. 7C depicts a step of forming a piezoelectric material film.
Figure 7D:
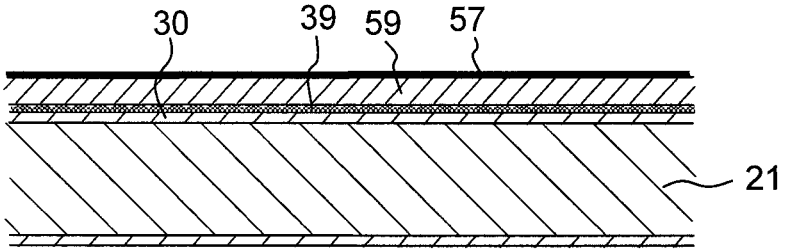
FIG. 7D depicts a step of forming a conductive film for an upper electrode.
Figure 7E:
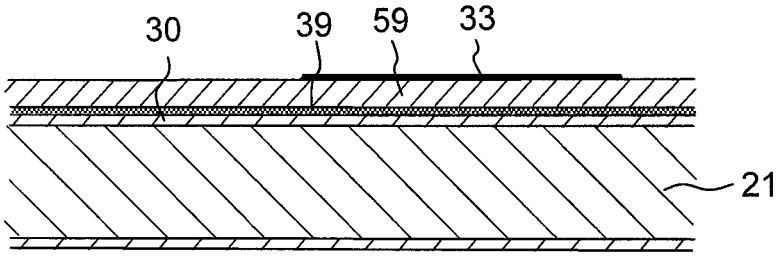
FIG. 7E depicts a step of etching the conductive film (a step of forming the upper electrode).

First, as depicted in FIG. 7A, the vibration film 30 of silicon dioxide is formed on a surface of the channel substrate 21 that is a silicon substrate. As a film formation method for the vibration film 30, it is possible to adopt thermal oxidation processing as preferred. Next, as depicted in FIG. 7B, the common electrode 39, which will be the lower electrodes 31, is formed as a film on the vibration film 30 by way of sputtering or the like. Further, as depicted in FIG. 7C, a piezoelectric material film 59, which is made from a piezoelectric material such as PZT, is formed on the entire area of the upper surface of the common electrode 39, by way of a sol-gel method, sputtering, or the like.

Further, the upper electrodes 33 are formed on the upper surface of the piezoelectric material film 59. First, as depicted in FIG. 71), an electroconductive film 57 is formed on the upper surface of the piezoelectric material film 59 by way of sputtering or the like. Next, by etching the electroconductive film 57, the upper electrodes 33 are formed on the upper surface of the piezoelectric material film 59.

Figure 8A:
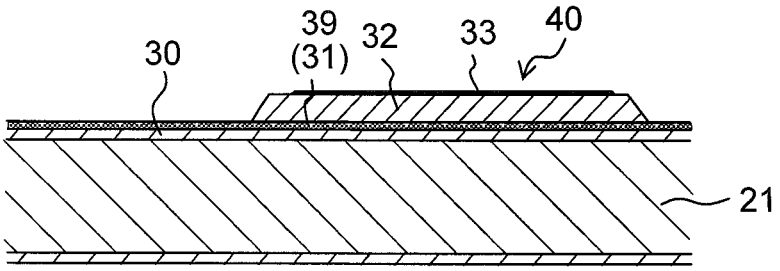
FIG. 8A depicts a step of etching the piezoelectric material film (a step of forming a piezoelectric element)
Figure 8B:
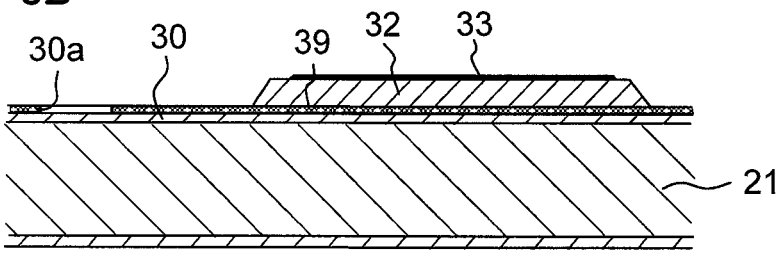
FIG. 8B depicts a step of etching the common electrode.

As depicted in FIG. 8A, the piezoelectric material film 59 is etched to form the piezoelectric films 32, thus forming the piezoelectric elements 40 on the vibration film 30. Further, as depicted in FIG. 8B, the common electrode 39 is etched to form a hole 31*a* to construct part of each of the communicating holes 22*a* (see FIG. 4) of the piezoelectric actuator 22.

Figure 8C:
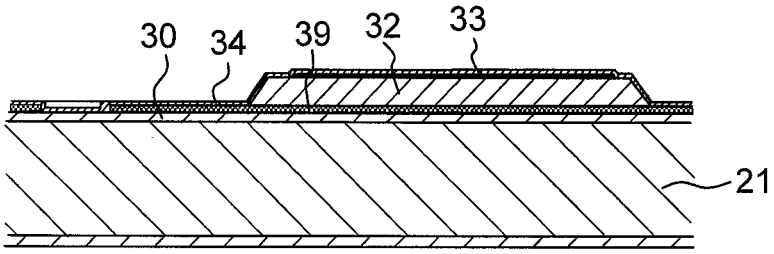
FIG. 8C depicts a step of forming a protective film.
Figure 8D:
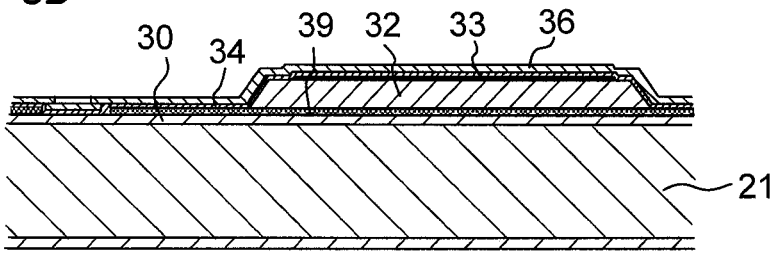
FIG. 8D depicts a step of forming an insulating film between layers.

Next, as depicted in FIG. 8C, the protective film 34 is formed by way of sputtering or the like to cover the piezoelectric elements 40. Further, as depicted in FIG. 8D, the insulating film 36 is formed on the protective film 34. The insulating film 36 is formed to cover the piezoelectric elements 40 as well as the partition walls 28 provided between the adjacent piezoelectric elements 40. It is possible to form the insulating film 36 made from silicon dioxide by way of plasma CVD as preferred.

Figure 8E:
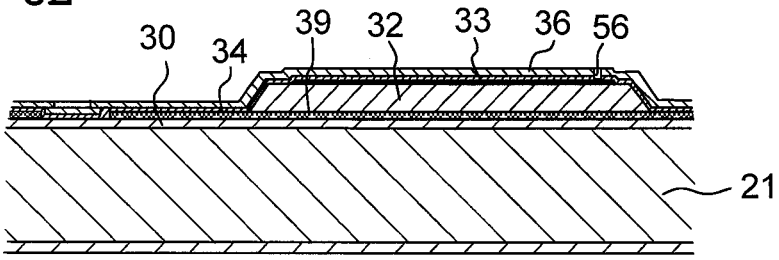
FIG. 8E depicts a step of forming a hole for electrical conduction between the upper electrode and a trace.

After forming the protective film 34 and the insulating film 36, as depicted in FIG. 8E, a hole 56 is formed by way of etching in such a part, of the protective film 34 and insulating film 36, covering an end of each of the upper electrodes 33. The holes 56 serve for electrical conduction between the upper electrodes 33 and the traces 35 to be formed on the insulating film 36 in the next step.

Figure 9A:
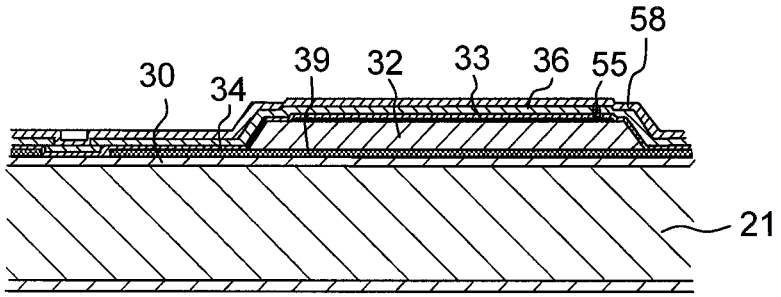
FIG. 9A depicts a step of forming a conductive film for the trace.
Figure 9B:
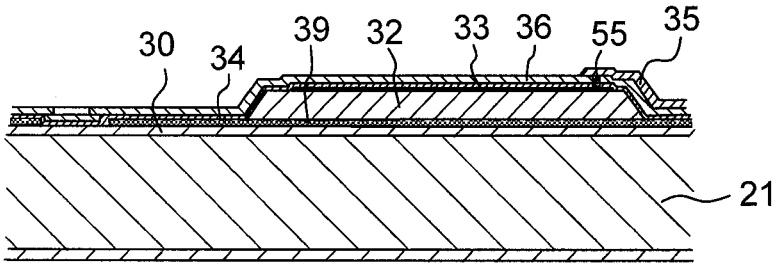
FIG. 9B depicts a step of etching the conductive film (a step of forming the trace)

Subsequently, the traces 35 are formed on the insulating film 36 upon the protective film 34. First, as depicted in FIG. 9A, an electroconductive film 58 is formed on the upper surface of the insulating film 36 by way of sputtering or the like. On this occasion, the holes 56 are filled with part of an electroconductive material to form a conducting portion 55 in each of the holes 56 to electrically conduct the upper electrodes 33 and the electroconductive film 58. Next, as depicted in FIG. 9B, the electroconductive film 58 is etched to remove unnecessary parts and form the traces 35.

Figure 9C:
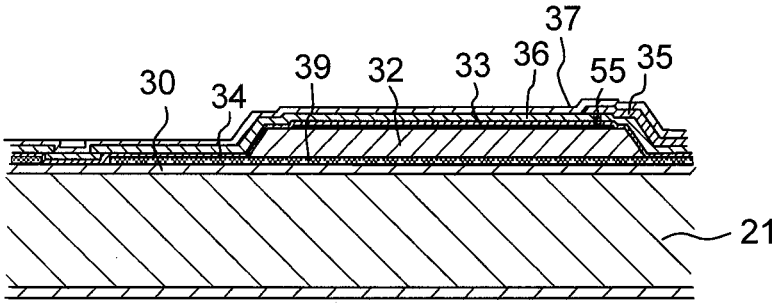
FIG. 9C depicts a step of forming a trace protective film.

Next, as depicted in FIG. 9C, the trace protective film 37 is formed to cover the piezoelectric elements 40 and the traces 35 connected to the piezoelectric elements 40 respectively. As with the insulating film 36 formed previously, the trace protective film 37 made from silicon nitride ($SiN_x$) is preferably formed by way of plasma CVD.

Figure 10A:
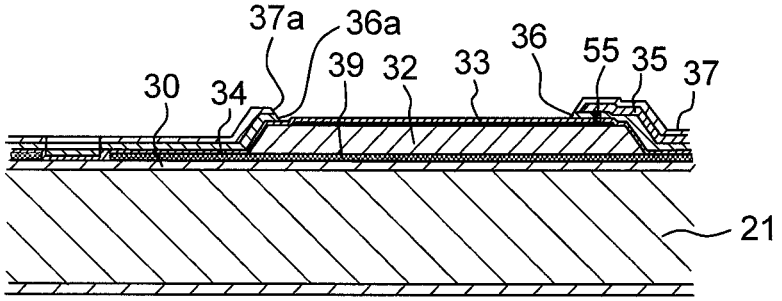
FIG. 10A depicts a step of partially removing the insulating film between layers and the trace protective film.

Next, as depicted in FIG. 10A, the trace protective film 37 and the insulating film 36 are etched to remove, at a time, such parts of the trace protective film 37 and the insulating film 36 that overlap with the piezoelectric elements 40. By virtue of this, the openings 37*a* are formed in the trace protective film 37 while the openings 36*a* are formed in the insulating film 36 to expose the protective film 34 thereunder.

Specifically, removal of the trace protective film 37 and the insulating film 36 is performed as follows. At first, a mask covering areas other than the formation areas of the openings 36*a*, 37*a* is formed on a surface of the trace protective film 37 through photoresist. After forming the mask, etching is performed from the surface of the trace protective film 37 to remove the trace protective film 37 and the insulating film 36 at a time. Then, the openings 36*a*, 37*a* are formed in areas, of the two kinds of films 36 and 37, which are not covered with the mask. After the etching, the mask is released and removed.

Figure 11:
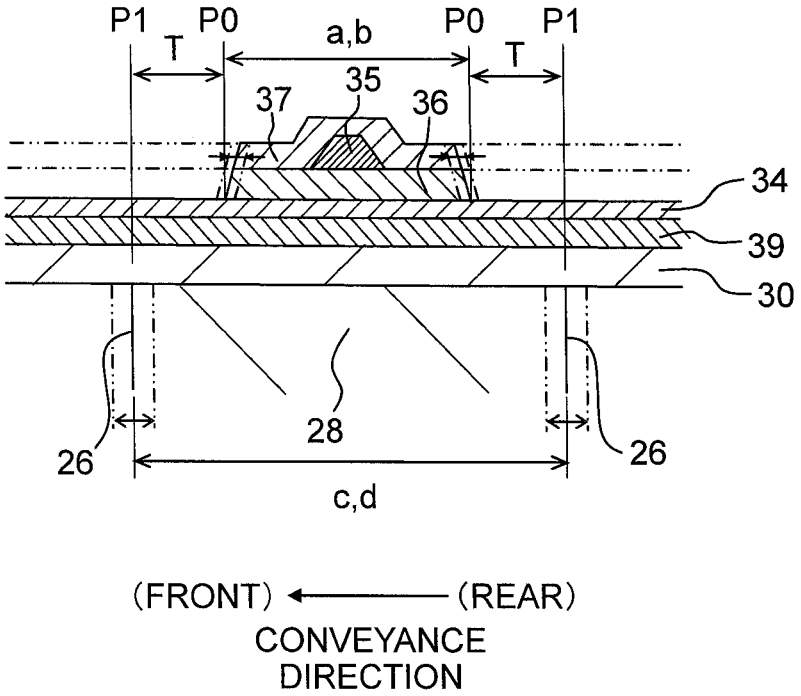
FIG. 11 illustrates the step of removing the insulating film between layers and the trace protective film.

As depicted in FIG. 11, the insulating film 36 disposed under the trace 35 and the trace protective film 37 covering the trace 35 from above are not removed but remain in an area including the partition wall 28 partitioning two pressure chambers 26 adjacent to each other in the conveyance direction. In that case, the ends of the insulating film 36 and the trace protective film 37 are formed not to extend beyond the ends of the partition wall 28.

In particular, the removal step is performed by setting a target formation position P0 for an end of the insulating film 36 and the trace protective film 37 in the conveyance direction at the inside of a target formation position P1 for an end of the partition wall 28. Here, "the target formation position of an end of the films 36, 37" means a target position of an end of the films 36, 37 in a case of etching them, and thus a mask position, an etching amount, and the like are adjusted to position the end of the films 36, 37 in the target position. Similarly, "the target formation position of an end of the partition wall 28" means a target position of an end of the partition wall 28 when the channel substrate 21 is etched to form the pressure chamber 26 in a step of forming the pressure chamber 26 as described later (FIG. 12B), and thus a mask position, an etching amount, and the like are adjusted to position the end of the partition wall 28 in the target position. In other words, the "target formation positions" mean positions (sizes) that are explicitly stated in a design drawing for manufacture of the head unit.

Here, various kinds of deviations caused during etching for the films 36, 37 may cause deviations of the ends of the films 36, 37 from the target formation positions P0 as depicted by two-dot chain lines in FIG. 11. Similarly, various kinds of deviations caused when etching is performed to form the pressure chamber 26 may cause deviations of the ends of the partition wall 28 from the target formation positions P1. As a result, the ends of the films 36, 37 after processing may not be positioned inside the ends of the partition wall 28.

The inventors of the present application manufactured a head unit in such a setting in which the ends of the films 36, 37 are coincident with the the ends of the partition wall 28, and they conducted a drive test. The vibration film 30 cracked during the test. The investigation revealed that, due to deviations during etching, the ends of the films 36, 37 extend beyond the ends of the partition wall 28 and the films 36, 37 partially overlapped with the pressure chambers 26. The thickness of the vibration film 30 of this trial product is from 1.0 to 1.4 μm.

In view of the above, the target formation position P0 for the end of the films 36, 37 is preferably positioned inside the target formation position P1 for the end of the partition wall 28 by not less than 3 μm. The reason thereof is as follows.

In the step of removing the insulating film 36 and the trace protective film 37, a mask deviation causes a position (a) of the films disposed above the partition wall 28 to vary, and a processing deviation during etching causes a film width (b) to vary. Those variations may cause positions of ends of the films 36, 37 to deviate. In the step of forming the pressure chamber 26 (FIG. 12B), a mask deviation causes a position (c) of the partition wall 28 to vary and the processing deviation during etching causes a width (d) of the partition wall 28 to vary. Those variations may cause positions of ends of the partition wall 28 to deviate. Namely, a distance T between an end position of the films 36, 37 and an end position of the partition wall 28 varies within a certain range. Thus, the target formation position P0 for the end of the films 36, 37 is preferably set in such a manner that, even when various kinds of deviations have occurred, the actual end position of the films 36, 37 is positioned inside the target formation position P1 for the end of the partition wall 28.

Although degrees of various deviations described above depend on the precision of an apparatus to be used for etching the films 36, 37 and forming the pressure chamber 26, they may have values indicated in Table 1. The values in Table 1 indicate values for 3σ, and the probability that deviations are within that range is 99.7%. In Table 1, "mask deviation" means the degree of a position deviation caused when an etching mask deviates in parallel with respect to a planer direction; "processing deviation" means the degree of a width deviation caused by etching processing. For example, "mask deviation in pressure chamber formation is ±3 μm" means that the etching mask deviates from a target setting position by a maximum of 3 μm when the channel substrate 21 is etched to form the pressure chamber 26.

| Step in which deviation occurs | Subject | Kind of deviation | Degree of deviation |
|---|---|---|---|
| Etching for trace protective layer and insulating layer | Film position (a) | Mask deviation | ±0.2 μm |
| | Film width (b) | Processing deviation | ±0.2 μm |
| Pressure chamber formation (Etching for channel substrate) | Partition wall position (c) | Mask deviation | ±3 μm |
| | Partition wall width (d) | Processing deviation | ±2 μm |

As described above, removing the insulating film 36 and the trace protective film 37 at a time reduces the number of removal steps. This means that opportunities causing the mask deviation and processing deviation are reduced. On the other hand, when removal of the two kinds of films 36, 37 are performed individually, two removal steps are required. Thus, the mask deviation and processing deviation may be caused in respective two removal steps, increasing the total deviation amount.

On the basis of the degrees of deviations indicated in Table 1, investigation will be made about a proper manner of setting for the target formation position P0.

(1) In a certain manner, we focus attention on a mask deviation (a maximum of 3 μm) in pressure chamber formation having the maximum deviation amount among kinds of deviations indicated in Table 1. Namely, the target formation position P0 is set so that the end position of the films 36, 37 is prevented from being positioned outside the partition wall 28 even in occurrence of the mask deviation having the maximum deviation amount. According to this manner, it is only required that the target formation position P0 for the end of the film 36, 37 be set at the inside of the target formation position P1 for the end of the partition wall 28 by not less than 3 μm.

(2) In another manner, the target formation position P0 may be set so that the end position of the films 36, 37 do not extend beyond the end of the partition wall 28 even in occurrence of all kinds of deviations indicated in Table 1. In that configuration, the target formation position P0 may be set on the basis of a sum of maximum values of all kinds of deviations, that is, a value obtained by summing the respective worst values. However, the probability that all kinds of deviations have respective maximum deviation amounts is almost zero, and thus setting for satisfying such a condition is unrealistic.

Thus, the target formation position P0 is preferably determined based on "square sum of common difference (square sum of tolerance)". As a precondition, four kinds of sizes (a to d) indicated in Table 1 do not interfere with each other. Namely, a to d are independent subjects. In that case, on the assumption that the variation of the distance T follows a normal distribution, a distribution $T^2$ of the distance T is represented by the following formula in accordance with distribution additivity.

$$T^2 = (a)^2 + \left(\frac{b}{2}\right)^2 + (c)^2 + \left(\frac{d}{2}\right)^2 \qquad \text{Formula 1}$$

The processing deviations (b), (d) indicated in Table 1 mean width deviation values including the film width and partition wall width. Thus, when a deviation amount of an end position is determined, a half value of the width deviation value is used for the width deviation, as indicated in Formula 1. The following formula is obtained by modifying Formula 1 in a form of a standard deviation.

$$T = \sqrt{(a)^2 + \left(\frac{b}{2}\right)^2 + (c)^2 + \left(\frac{d}{2}\right)^2}$$

When respective deviation values indicated in Table 1 are substituted for a to d, T is 3.17. Since the a to d values are values for 3σ T is not more than 3.17 μm with 99.7% probability. In a practical way, when the target formation position P0 of the end of the films 36, 37 is set inside the target formation position P1 of the end of the partition wall 28 by not less than 3 μm, the films 36, 37 do not extend beyond the ends of the partition wall 28.

The target formation position P0 of the end of the films 36, 37 disposed above the partition wall 28 may be expressed by a relation with the dimension of the partition wall 28. When the nozzles 24 and the pressure chambers 26 are arrayed at 300 dpi, the array pitch of the pressure chambers 26 is 84.7 μm (size A in FIG. 5). Meanwhile, in order to jet ink normally from each nozzle 24, the pressure chamber 26 is preferably 60 to 70 μm in width (size B in FIG. 5). Under both of the conditions, the partition wall 28 partitioning two pressure chambers 26 may be 14.7 to 24.7 μm in width (size C in FIG. 5). In that case, setting the target formation position P0 of the end of the films 36, 37 at a position having 3 μm distance from the target formation position P1 of the partition wall 28 has the same meaning as setting the distance between P0 and P1 to be 12% (3 μm/24.7 μm) to 20% (3 μm/12.7 μm) of the width of the partition wall 28. Namely, in order to make the distance between P0 and P1 3 μm or longer, the distance may be set to be not less than 12% of the width of the partition wall 28.

The relation between the width of the films 36, 37 and the width of the partition wall 28 after performing the removal step of the films 36, 37 is as follows. When the target formation position P0 of the end of the films 36, 37 is set at the position having 3 μm distance from the end of the partition wall 28, the width W of the films 36, 37 depicted in FIG. 6 is theoretically reduced by 6 μm in total, specifically 3 μm each on the left and right sides, as compared to the width W1 of the partition wall 28. In a practical way, however, it is necessary to include a width variation of the films caused by the processing deviation of the films 36, 37 indicated in Table 1 and a width variation of the partition wall 28 caused by the processing deviation of the pressure chamber 26. By including those variations, the relation between the width W of the films 36, 37 to be actually formed and the width W1 of the partition wall 28 is determined as follows.

$$W \leq W1-(3\ \mu m \times 2)+(0.2\ \mu m)+(2\ \mu m)=W1-3.8\ \mu m$$

Figure 10B:
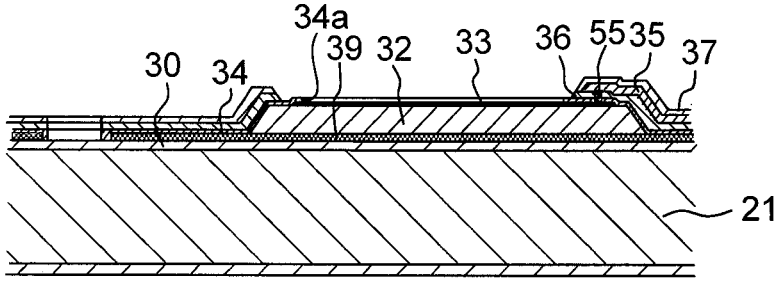
FIG. 10B depicts a step of partially removing the protective film.
Figure 10C:
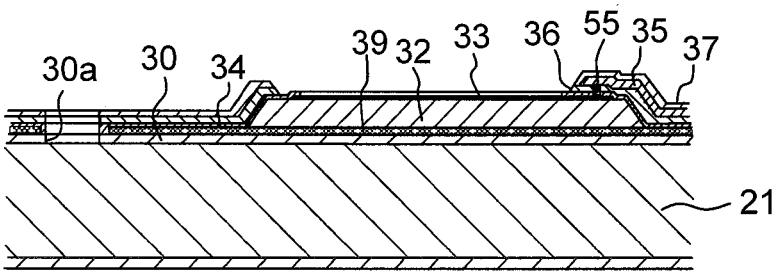
FIG. 10C depicts a step of forming a hole of a vibration plate.

The step of removing the trace protective film 37 and the insulating film 36 is completed in the step of 10A. Next, as depicted in FIG. 10B, the protective film 34 exposed from the trace protective film 37 and the insulating film 36 is etched to form the opening 36*a* in the protective film 34. Further, as depicted in FIG. 10C, the vibration film 30 is etched to form a hole 30*a* that is a part of the communicating hole 22*a* (see FIG. 4) of the piezoelectric actuator 22. Manufacture of the piezoelectric actuator 22 is completed in the step of FIG. 10C.

Figure 12A:
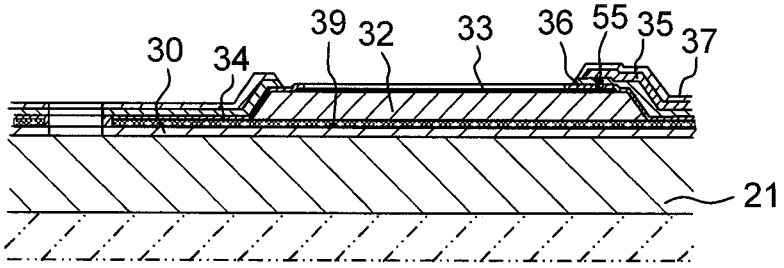
FIG. 12A depicts a step of polishing a channel substrate.

As depicted in FIG. 12A, the channel substrate 21 in which ink channels are to be formed is partially removed by being polished from a lower surface side (on the side opposite to the vibration film 30), thus reducing the thickness of the channel substrate 21 to have a predefined thickness. Although a silicon wafer that is an original of the channel substrate 21 has a thickness of approximately 500 to 700 μm, the channel substrate 21 is polished to have a thickness of approximately 100 μm during the polish step.

Figure 12B:
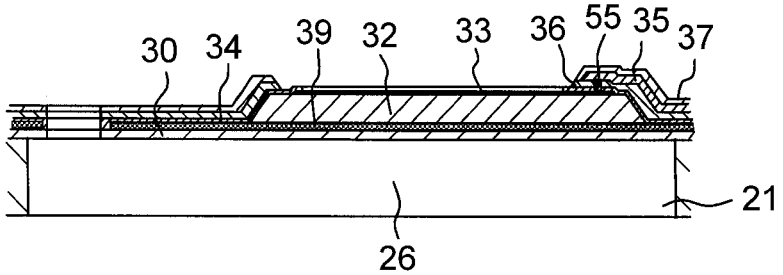
FIG. 12B depicts a step of etching the channel substrate (a step of forming the pressure chamber)
Figure 12C:
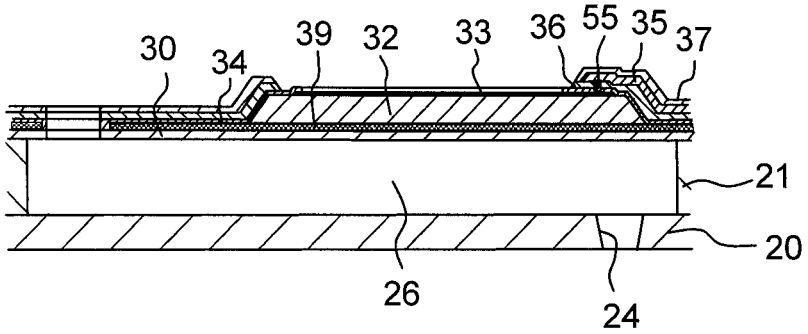
FIG. 12C depicts a joining step of a nozzle plate.
Figure 12D:
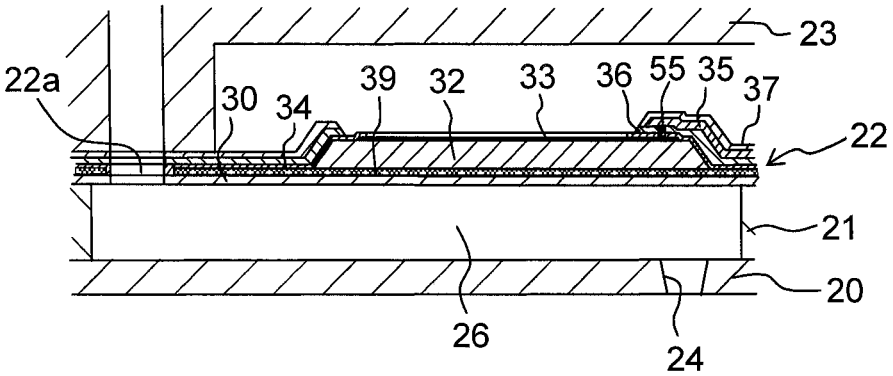
FIG. 12D depicts a joining step of a reservoir formation member.

After the polish step, as depicted in FIG. 12B, etching is performed for the channel substrate 21 from the lower surface side that is opposite to the side of the vibration film 30, thus forming the pressure chamber 26. The etching for the channel substrate 21 may be wet etching or dry etching. In general, however, dry etching generates not only chemical reactivity but also physical reactivity, and thus the vibration film 30 may be etched to have a thickness smaller than a target thickness. Accordingly, the present teaching is especially preferably used in a case of forming the pressure chamber 26 through dry etching. Further, as depicted in FIG. 12C, the nozzle plate 20 is joined to the lower surface of the channel substrate 21 with adhesive. Finally, as depicted in FIG. 12D, the reservoir formation member 23 is joined to the piezoelectric actuator 22 with adhesive.

In the above embodiment, the conveyance direction and the lateral direction of the pressure chamber 26 correspond to "first direction" of the present teaching, and the scanning direction and the longitudinal direction of the pressure chamber 26 correspond to "second direction" of the present teaching. Two pressure chambers 26 of the right-side pressure chamber array 27*b* correspond to "first pressure chamber" and "second pressure chamber" of the present teaching. The vibration film 30 corresponds to "first insulating film" of the present teaching. Two piezoelectric elements 40 of the right-side piezoelectric element array 41*b* correspond to "first piezoelectric element" and "second piezoelectric element" of the present teaching. The trace protective film 37 corresponds to "second insulating film" of the present teaching. The insulating film between layers 36 corresponds to "third protective film" of the present teaching.

The step of forming the trace protective film 37 depicted in FIG. 9C corresponds to "first-order insulating film formation step" of the present teaching. The step of forming the insulating film 36 depicted in FIG. 8D corresponds to "second-order insulating film formation step" of the present teaching. The step of removing the trace protective film 37 and the insulating film 36 correspond to "first removal step" of the present teaching.

Subsequently, an explanation will be made about modified embodiments in which various modifications are added to the above embodiment. The components or parts, which are the same as or equivalent to those of the embodiment described above, are designated by the same reference numerals, any explanation therefor will be omitted as appropriate.

Figure 13:
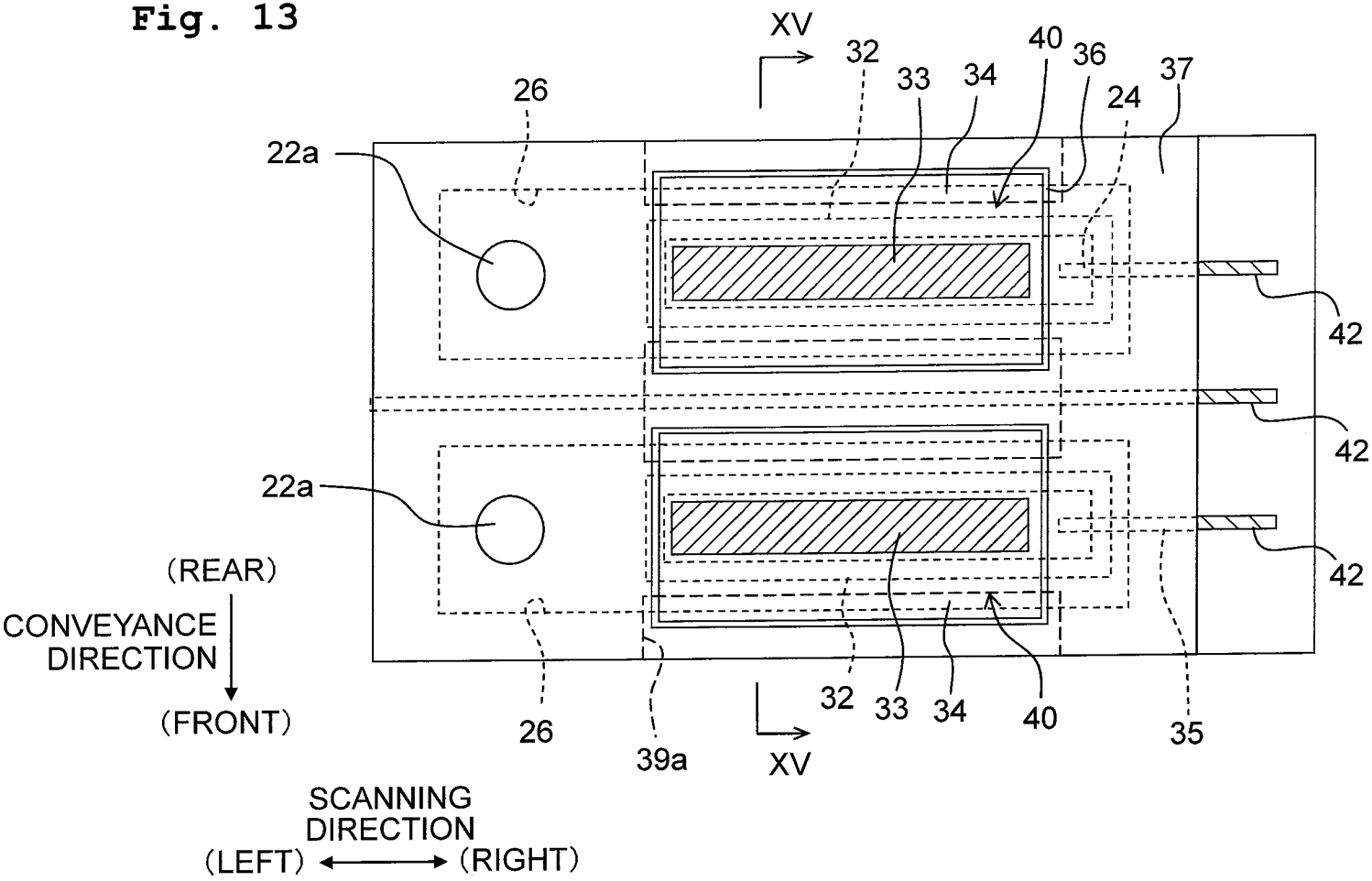
FIG. 13 is a partially enlarged top view depicting a head unit according to a modified embodiment of the present teaching.
Figure 14:
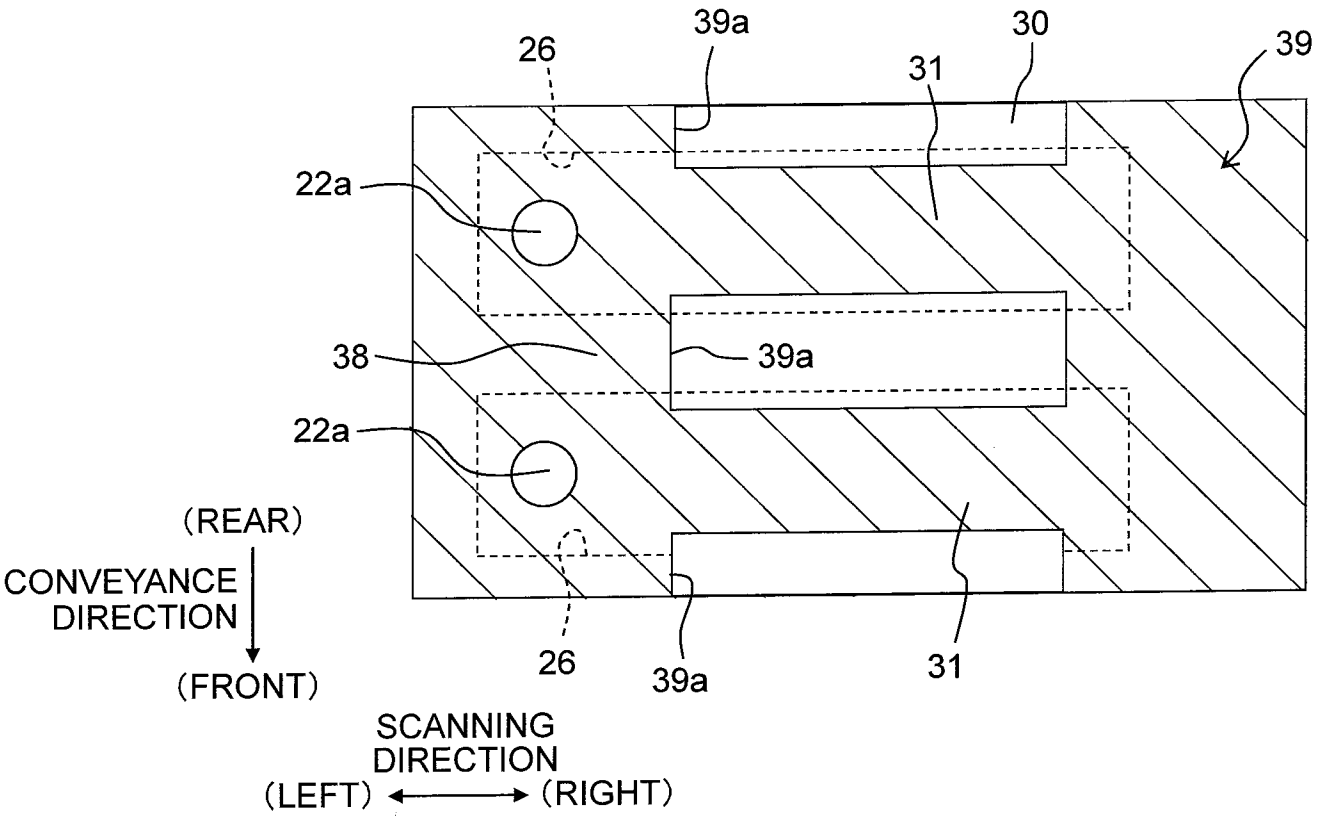
FIG. 14 is a plan view of a common electrode of the head unit depicted in FIG. 13.
Figure 15:
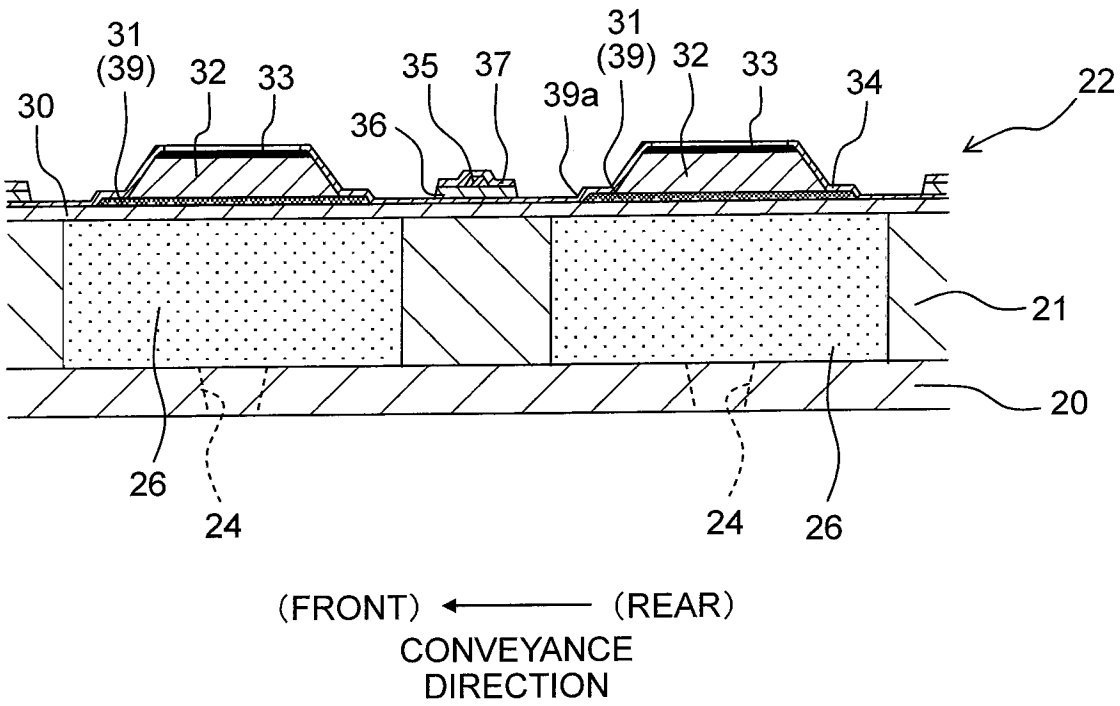
FIG. 15 is a cross-sectional view taken along a line XV-XV of FIG. 13.

In the embodiment, the common electrode 39 including the lower electrodes 31 and the conductive films 38 is formed on the almost entire area of the upper surface of the vibration film 30. Each of the conductive films 38 is disposed on the corresponding one of the partition walls 28 (see FIG. 5). In this configuration, due to contraction of the common electrode 39 in a case of baking or firing of the piezoelectric element 40, great tensile stress acting in a planer direction of the channel substrate 21 remains on each piezoelectric element 40 and the channel substrate 21. The tensile stress is one of the factors obstructing deformation of the piezoelectric element 40. In view of this, as depicted in FIGS. 13 to 15, the common electrode 39 may be patterned to be formed with openings 39*a* between piezoelectric elements 40 arranged in the conveyance direction. This prevents the common electrode 39 from contracting entirely and greatly, thus reducing the tensile stress.

At positions of the common electrode 39 formed with the openings 39*a*, however, no metallic film having ductility and malleability is present on the surface of the vibration film 30, thus those positions are vulnerable to a crack. In order to solve that problem, the ends of the insulating film 36 and the trace protective film 37 are preferably positioned inside the ends of the partition wall 28 for the purpose of preventing the vibration film 30 from having a crack.

In the above embodiment, the pressure chambers 26 form two pressure chamber arrays 27, and the piezoelectric elements 40 are also arranged in two arrays corresponding to the arrangement of the pressure chambers 26. The number of arrays of the pressure chambers 26 and the piezoelectric elements 40, however, is not limited to two arrays.

Figure 16:
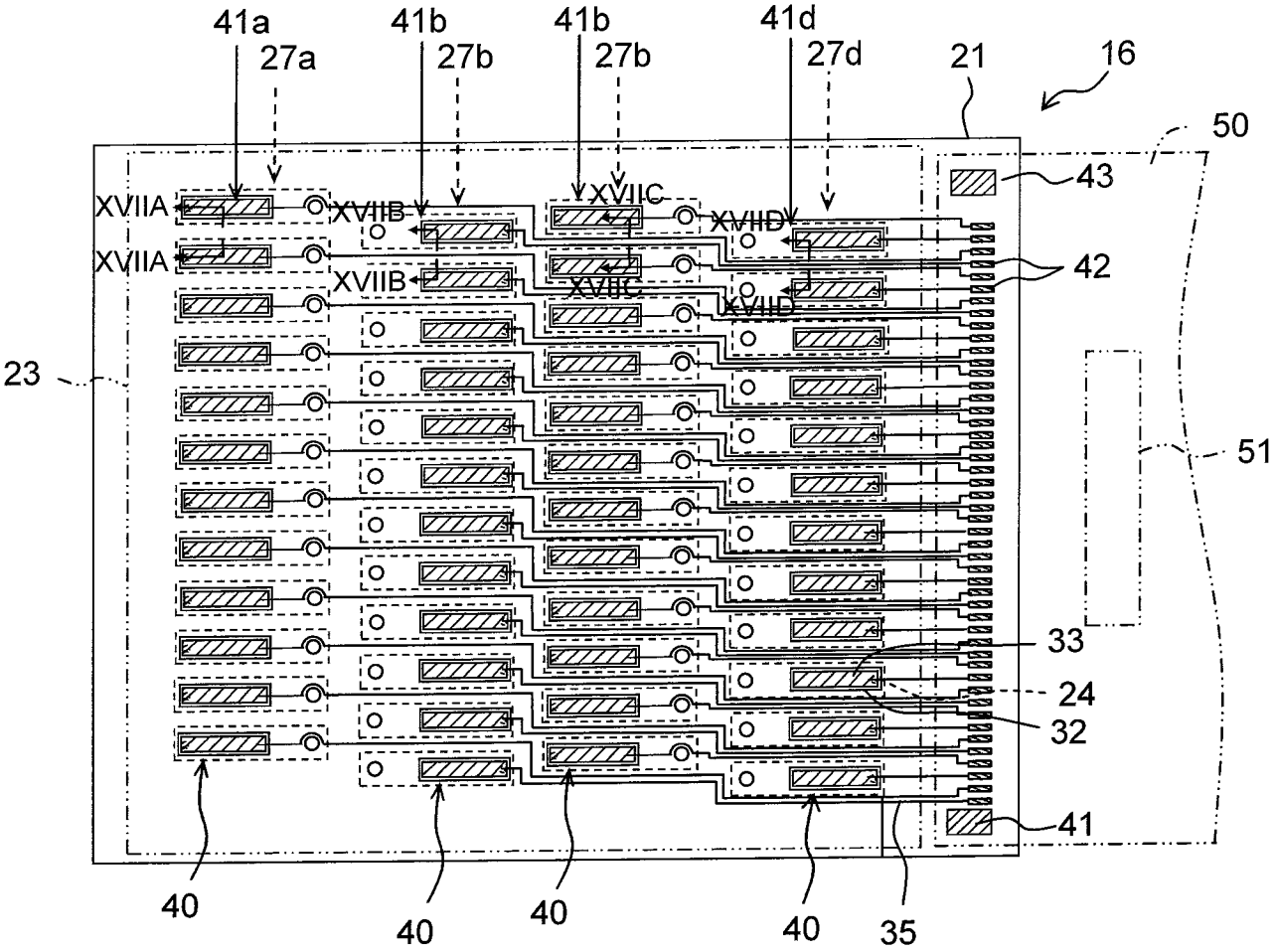
FIG. 16 is a top view of a head unit according to another modified embodiment of the present teaching.
Figure 17A:
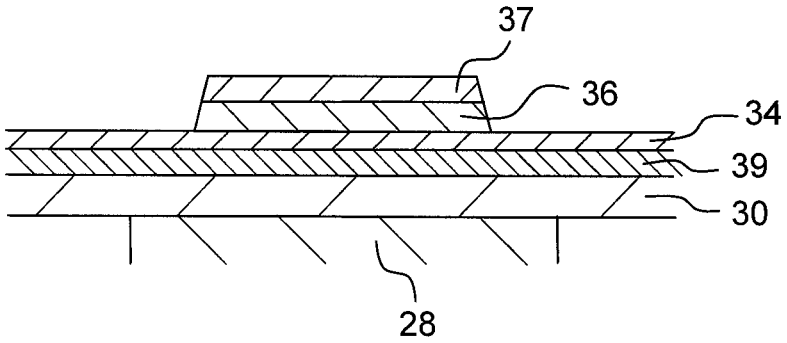
FIG. 17A is a cross-sectional view taken along a line A-A of FIG. 16.
Figure 17B:
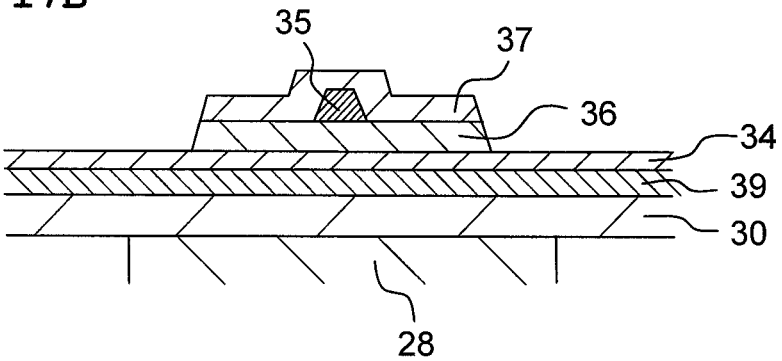
FIG. 17B is a cross-sectional view taken along a line B-B of FIG. 16.
Figure 17C:
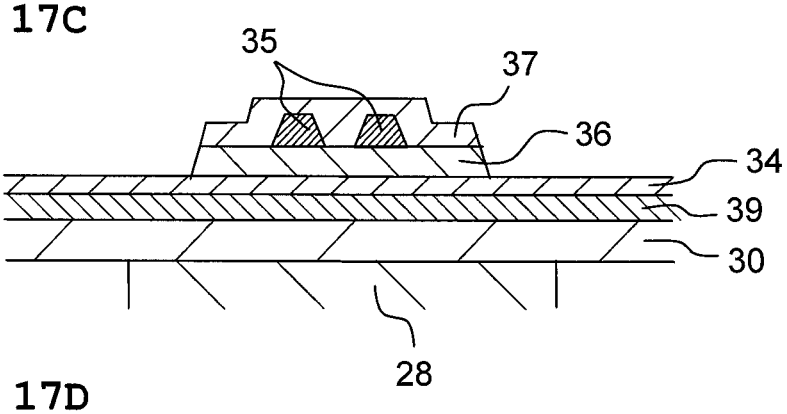
FIG. 17C is a cross-sectional view taken along a line C-C of FIG. 16.
Figure 17D:
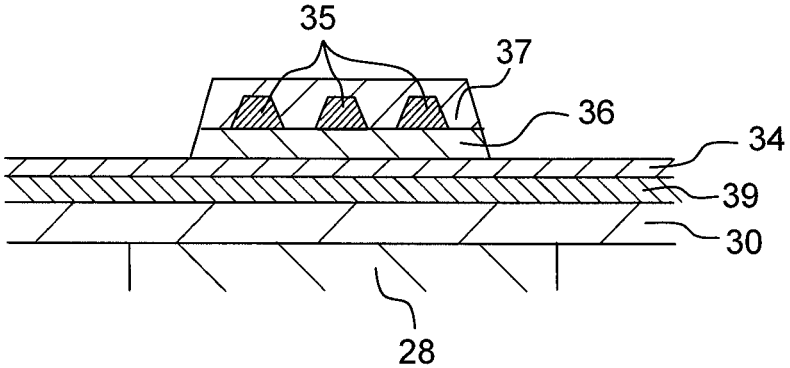
FIG. 17D is a cross-sectional view taken along a line D-D of FIG. 16.

For example, as depicted in FIG. 16, the number of arrays of the pressure chambers 26 and the piezoelectric elements 40 may be four arrays. Traces 35 are connected to the respective piezoelectric elements 40 forming the four piezoelectric element arrays 41 (41*a* to 41*d*), and all of the traces 35 are drawn out rightward. In that configuration, the number of traces 35 arranged between the piezoelectric elements 40 is different between the four piezoelectric element arrays 41.

As depicted in FIGS. 17A to 17D, in each of the four piezoelectric element arrays 41, the insulating film 36 and the trace protective film 37 are formed between the piezoelectric elements 40 adjacent to each other in the conveyance direction. The piezoelectric element array 41*a* positioned at the leftmost end has no traces 35 arranged between adjacent piezoelectric elements 40. The trace protective film 37, however, is formed above each partition wall 28, as with other piezoelectric element arrays 41.

When the number of traces 35 arranged between the piezoelectric elements 40 is different between the four piezoelectric element arrays 41, the width of the insulating film 36 and the trace protective film 37 may depend on the number of traces 35. However, when the width of the insulating film 36 and the trace protective film 37 disposed above the partition wall 28 is different between the four piezoelectric element arrays 41, the distance between the end of the films 36, 37 and the end of the partition wall 28, namely, the distance to the end of the pressure chamber 26 is different between the four piezoelectric element arrays 41. This causes displacement of the vibration film 30 to vary between the piezoelectric elements 40, thus leading to unevenness of jetting characteristics between the nozzles 24.

Thus, regardless of the number of traces 35 arranged between the piezoelectric elements 40, the four piezoelectric element arrays 41 are preferably configured such that parts of the films 36 and 37 covering the traces 35 are identical in width. Namely, in the removal step for the films 36 and 37, the target formation position P0 of the end of the films 36, 37 is set to be common between the four piezoelectric element arrays 41. This allows the four piezoelectric element arrays 41 to have almost the same distance from the end of the partition wall 28 to the end of the films 36 and 37, thus uniformizing jetting characteristics.

In the embodiment depicted in FIGS. 16 and 17, two pressure chambers 26 belonging to one pressure chamber array 27 correspond to "first pressure chamber" and "second pressure chamber" of the present teaching. Two pressure chambers 26 belonging to another pressure chamber array 27 correspond to "third pressure chamber" and "fourth pressure chamber" of the present teaching. Two piezoelectric elements 40 corresponding to the one pressure chamber array 27 correspond to "first piezoelectric element" and "second piezoelectric element" of the present teaching. Two piezoelectric elements 40 corresponding to the another pressure chamber array 27 correspond to "third piezoelectric element" and "fourth piezoelectric element" of the present teaching.

In the above embodiment, the insulating film 36 and the trace protective film 37 are removed through etching at a time, the insulating film 36 and the trace protective film 37, however, may be removed through different steps. In that case, the step of removing the trace protective film 37 corresponds to "first removal step" of the present teaching, and the step of removing the insulating film 36 corresponds to "second removal step" of the present teaching.

In the above embodiment, each trace 35 covered with the trace protective film 37 is a trace for applying driving potential to the piezoelectric element 40. The trace 35, however, is not limited to such a trace. For example, each trace 35 may be a ground trace connected to the common electrode.

In the above embodiment, the lower electrodes that are conducted to each other between the piezoelectric elements form the common electrode, and the upper electrodes are individual electrodes provided separately for each of the piezoelectric elements. The present teaching, however, is not limited thereto. The lower electrodes may be individual electrodes, and the upper electrodes may form the common electrode.

The piezoelectric actuator 22 of the above embodiment includes two kinds of films: the insulating film 36 and the trace protective film 37. The present teaching, however, is not limited thereto. The piezoelectric actuator 22 may include any one of the insulating film 36 and the trace protective film 37.

For example, like the above embodiment depicted in FIG. 15, when no common electrode 39 is disposed immediately under the trace 35, the insulating film 36 may not be formed at least above the partition wall 28.

When the traces 35 are made from aluminum, the trace protective film 37 covering the traces 35 is preferably provided to prevent corrosion and the like. When the traces 35 are made from any stable material such as gold, the trace protective film 37 may not be formed.

In the above embodiment and modified embodiments, the present teaching is applied to the ink-jet head that discharges ink on the recording sheet to print an image or the like thereon. The present teaching, however, may be applied to a liquid discharge apparatus that is used in various ways of use other than the print of the image or the like. The present teaching can be also applied, for example, to a liquid discharge apparatus that discharges a conductive liquid onto a substrate to form a conductive pattern on a surface of the substrate.

What is claimed is:

1. A liquid jetting apparatus comprising:

a first pressure chamber;

a first piezoelectric film;

a first electrode positioned between the first pressure chamber and the first piezoelectric film, wherein the first electrode is wider than the first piezoelectric film in a first direction;

a second pressure chamber located next to the first pressure chamber in the first direction;

a second piezoelectric film located next to the first piezoelectric film in the first direction;

a second electrode positioned between the second pressure chamber and the second piezoelectric film, wherein the second electrode is located next to the first electrode in the first direction;

at least one trace positioned between the first piezoelectric film and the second piezoelectric film in the first direction;

a common electrode having an opening formed therethrough, wherein the common electrode comprises the first electrode and the second electrode, and the second end of the first electrode is separate and apart from the third end of the second electrode by the opening in the first direction;

a first protective film covering the first and second ends of the first electrode and the third and fourth ends of the second electrode, the opening of the common electrode being covered by the first protective film; and a second protective film covering the at least one trace, wherein the first electrode has a first end and a second end opposite to the first end in the first direction, the second electrode has a third end and a fourth end opposite to the third end in the first direction, the second end of the first electrode is located next to the third end of the second electrode in the first direction, the second end of the first electrode is separate and apart from the third end of the second electrode in the first direction, and a distance between the first end of the first electrode and the fourth end of the second electrode in the first direction is greater than a distance between the second end of the first electrode and the third end of the second electrode in the first direction, wherein the second protective film has two ends between the second end of the first electrode and the third end of the second electrode in the first direction.

2. The liquid jetting apparatus of claim 1, wherein the second protective film comprises an insulating film.

3. The liquid jetting apparatus of claim 2, wherein the second protective film comprises silicon nitride.

4. The liquid jetting apparatus of claim 2, wherein the second protective film has a thickness of 100 nanometer to 1 micrometer.

5. The liquid jetting apparatus of claim 1, wherein the at least one trace is drawn out from between the second end of the first electrode and the third end of the second electrode, and is connected to an electrical contact.

6. The liquid jetting apparatus of claim 1, further comprising a partition wall partitioning the first pressure chamber and the second pressure chamber in the first direction, wherein the partition wall has a fifth end and a sixth end opposite to the fifth end in the first direction, and the two ends of the second protective film are positioned between the fifth end and the sixth end in the first direction.

7. The liquid jetting apparatus of claim 1, further comprising:

a partition wall partitioning the first pressure chamber and the second pressure chamber in the first direction; and an insulating film positioned between the partition wall and the trace.

8. The liquid jetting apparatus of claim 7, wherein the insulating film has two ends between the second end of the first electrode and the third end of the second electrode in the first direction.

9. The liquid jetting apparatus of claim 8, wherein the partition wall has a fifth end and a sixth end opposite to the fifth end in the first direction, wherein the two ends of the second protective film are positioned between the fifth end and the sixth end in the first direction, and the two ends of the insulating film are positioned between the fifth end and the sixth end in the first direction.

10. The liquid jetting apparatus of claim 1, wherein the number of at least one trace is two.

11. The liquid jetting apparatus of claim 1, wherein the number of at least one trace is three.

12. The liquid jetting apparatus of claim 1, wherein the second electrode is wider than the second piezoelectric film in the first direction.

* * * * *